US011951382B2

(12) United States Patent
Chen et al.

(10) Patent No.: US 11,951,382 B2
(45) Date of Patent: Apr. 9, 2024

(54) POWERED WHEELED BOARD

(71) Applicant: RAZOR USA LLC, Cerritos, CA (US)

(72) Inventors: Robert (Wei-Pin) Chen, Cerritos, CA (US); Hua Tao, Cerritos, CA (US); Huolai Guo, Cerritos, CA (US)

( * ) Notice: Subject to any disclaimer, the term of this patent is extended or adjusted under 35 U.S.C. 154(b) by 0 days.

(21) Appl. No.: 16/810,363

(22) Filed: Mar. 5, 2020

(65) Prior Publication Data

US 2020/0282296 A1 Sep. 10, 2020

Related U.S. Application Data

(60) Provisional application No. 62/814,450, filed on Mar. 6, 2019.

(51) Int. Cl.

| | |
|---|---|
| ***A63C 17/12*** | (2006.01) |
| *A63C 17/00* | (2006.01) |
| *A63C 17/01* | (2006.01) |

(52) U.S. Cl.

CPC ..... *A63C 17/12* (2013.01); *A63C 17/0033* (2013.01); *A63C 17/016* (2013.01); *A63C 2203/12* (2013.01); *A63C 2203/40* (2013.01)

(58) Field of Classification Search

CPC ... A63C 17/12; A63C 17/0033; A63C 17/016; A63C 2203/12; A63C 2203/40

See application file for complete search history.

(56) References Cited

U.S. PATENT DOCUMENTS

| | | | |
|---|---|---|---|
| 2,051,762 | A | 8/1936 | Vincent |
| 3,288,251 | A | 11/1966 | Paul |
| 3,399,904 | A | 9/1968 | Schinke |
| 3,399,906 | A | 9/1968 | Portnoff |
| 3,771,811 | A | 11/1973 | Bueno |
| 3,982,766 | A | 9/1976 | Budge |
| D243,206 | S | 1/1977 | Sherwood |
| 4,037,852 | A | 7/1977 | Bayer et al. |
| D246,065 | S | 10/1977 | Saul |
| 4,060,253 | A | 11/1977 | Oldendorf |
| 4,076,265 | A | 2/1978 | Eash |
| 4,076,267 | A | 2/1978 | Lipscomb |
| 4,082,306 | A | 4/1978 | Sheldon |
| 4,092,033 | A | 5/1978 | Swain |

(Continued)

FOREIGN PATENT DOCUMENTS

| | | |
|---|---|---|
| AU | 2007214338 | 3/2007 |
| CA | 2596570 | 10/2007 |

(Continued)

OTHER PUBLICATIONS

"About: Skateboarding; Other Boardsports", http://skateboard.about.com/cs/fringeboarding/gr/?once-true&; Mar. 2007, in 2 pages.

(Continued)

*Primary Examiner* — Brian L Swenson

(74) *Attorney, Agent, or Firm* — Knobbe, Martens, Olson & Bear, LLP

(57) ABSTRACT

Various powered personal mobility vehicles are disclosed. In some embodiments, the vehicle can include a deck having a forward portion, a rearward portion, and a neck portion. A front swivel wheel assembly and a rear swivel wheel assembly can be connected with the deck. In some embodiments, the front swivel wheel assembly comprises a motor.

20 Claims, 15 Drawing Sheets

(56) References Cited

U.S. PATENT DOCUMENTS 4,093,252 A 6/1978 Rue
D250,492 S 12/1978 Kish
4,140,326 A 2/1979 Huber
4,245,848 A 1/1981 Dudouyt
4,295,656 A 10/1981 Moore
4,359,231 A 11/1982 Mulcahy
4,411,442 A 10/1983 Rills
4,451,055 A 5/1984 Lee
4,458,907 A 7/1984 Meredith
4,902,256 A 2/1990 Berglund
4,915,403 A 4/1990 Wild
4,921,513 A 5/1990 Parten
4,930,794 A 6/1990 Chan
4,930,924 A 6/1990 Hunt
4,955,626 A 9/1990 Smith
5,067,058 A 11/1991 Standley
5,098,087 A 3/1992 Matile
5,160,155 A 11/1992 Barachet
5,221,111 A 6/1993 Younger
5,267,743 A 12/1993 Smisek
D345,406 S 3/1994 Shankland
D346,418 S 4/1994 Fischbach
5,330,026 A 7/1994 Hsu et al.
5,347,681 A 9/1994 Wattron et al.
5,419,570 A 5/1995 Bollotte
5,458,351 A 10/1995 Yu
5,460,558 A 10/1995 Woodstock
5,492,345 A 2/1996 Kruczek
5,505,474 A 4/1996 Yeh
5,529,523 A 6/1996 Wilhelmi
5,540,455 A 7/1996 Chambers
5,549,331 A 8/1996 Yun
5,566,956 A 10/1996 Wang
5,601,299 A 2/1997 Yun
5,622,759 A 4/1997 Fuster
5,707,068 A 1/1998 Bradfield
5,766,051 A 6/1998 Messer
5,826,895 A 10/1998 Bradfield
5,853,182 A 12/1998 Finkle
5,855,385 A 1/1999 Hambsch
5,884,983 A 3/1999 Wu
5,893,425 A 4/1999 Finkle
D410,515 S 6/1999 Alexander
5,910,035 A 6/1999 Rebotier et al.
D413,954 S 9/1999 Gerlach
5,947,495 A 9/1999 Null et al.
5,984,328 A 11/1999 Tipton
D422,661 S 4/2000 Edwards et al.
D422,662 S 4/2000 Edwards et al.
6,050,357 A 4/2000 Staelin
6,056,302 A 5/2000 Smith
6,059,303 A 5/2000 Bradfield
6,102,415 A 8/2000 Stewardson
6,106,347 A 8/2000 Harness
6,193,249 B1 2/2001 Buscaglia
6,206,389 B1 3/2001 Yagi
6,254,113 B1 7/2001 Dornan
6,293,565 B1 9/2001 Bouchard et al.
6,315,304 B1 11/2001 Kirkland et al.
6,328,328 B1 12/2001 Finiel
6,338,494 B1 1/2002 Killian
D455,186 S 4/2002 Koester
D456,047 S 4/2002 Mandic
6,398,237 B1 6/2002 Attey
6,419,248 B1 7/2002 Kay
6,419,249 B1 7/2002 Chen
6,428,022 B1 8/2002 Namiki
6,440,526 B1 8/2002 Gamble et al.
6,481,724 B1 11/2002 Whipp
6,485,044 B1 11/2002 Blake
6,494,467 B1 12/2002 Menges
6,502,850 B1 1/2003 Schaller et al.
6,572,130 B2 6/2003 Greene et al.
6,669,215 B2 12/2003 Laporte
6,698,776 B2 3/2004 Todd
6,808,196 B2 10/2004 Des Ouches
6,863,292 B1 3/2005 Paasch et al.
D503,763 S 4/2005 Morgan
D506,427 S 6/2005 Weber
6,910,698 B2 6/2005 Turner et al.
D510,046 S 9/2005 Li
6,976,687 B2 12/2005 Beleki, Jr.
6,979,006 B2 12/2005 Pierron
7,044,486 B2 5/2006 Wright
7,053,289 B2 5/2006 Iwai et al.
7,083,178 B2 8/2006 Potter
7,093,842 B2 8/2006 Potter
7,182,360 B2 2/2007 Paasch et al.
7,195,259 B2 3/2007 Gang
7,198,280 B2 4/2007 Hara
7,213,823 B1 5/2007 Vujtech
7,252,625 B1 8/2007 Perka
D552,201 S 10/2007 Kwak
D556,283 S 11/2007 Hamborg et al.
7,316,597 B2 1/2008 Skedeleski
D561,289 S 2/2008 Stanisewski
7,325,819 B2 2/2008 Kwak
D564,613 S 3/2008 Hamborg
7,338,056 B2 3/2008 Chen et al.
7,367,572 B2 5/2008 Jiang
D572,332 S 7/2008 Sramek et al.
D577,789 S 9/2008 Mazur
7,600,768 B2 10/2009 Chen
D607,521 S 1/2010 Chables et al.
D607,524 S 1/2010 Marciano
D608,851 S 1/2010 Hillman
D614,714 S 4/2010 Walworth
7,766,351 B2 8/2010 Chen et al.
7,775,534 B2 8/2010 Chen et al.
D623,701 S 9/2010 Dalgaard
D623,702 S 9/2010 Dalgaard et al.
7,867,050 B2 1/2011 Crispin
7,891,680 B2 2/2011 Chen et al.
D638,494 S 5/2011 Scolari et al.
8,047,556 B2 11/2011 Jang et al.
8,061,725 B1 11/2011 Hawkins
8,118,319 B2 2/2012 Hsieh
D655,772 S 3/2012 Bin
8,157,274 B2 4/2012 Chen
D667,382 S 9/2012 Consentino et al.
D673,233 S 12/2012 Baggett
8,360,475 B2 1/2013 Cristiano
8,408,565 B2 4/2013 An
8,414,000 B2 4/2013 Chen
8,469,376 B2 6/2013 Kristiansen
D692,079 S 10/2013 Mackay
D692,080 S 10/2013 Hamborg et al.
8,632,084 B2 1/2014 Lovley, II et al.
D698,881 S 2/2014 Hamborg
D699,803 S 2/2014 Yamabe
D705,372 S 5/2014 Harris
8,720,916 B2 5/2014 Bermal
8,857,831 B1 10/2014 Rotondo
8,864,152 B1 10/2014 Danze
8,915,506 B2 12/2014 Piaceski et al.
D724,166 S 3/2015 Hamborg et al.
D728,048 S 4/2015 Stover
9,010,778 B1 4/2015 Burns
D739,906 S 9/2015 Chen
D743,381 S 11/2015 Pi et al.
9,186,570 B1 11/2015 Wells
9,302,173 B2 4/2016 DiCarlo
9,393,481 B2 7/2016 Fournier
D770,585 S 11/2016 Desberg
9,492,731 B2 11/2016 Marusiak et al.
D785,115 S 4/2017 Ying
D789,366 S 6/2017 Jentz
D790,015 S 6/2017 Tan
9,682,309 B2 6/2017 Huang
D792,931 S 7/2017 Desberg
D799,450 S 10/2017 Lee et al.
9,795,864 B1 10/2017 Bao
9,975,035 B1 5/2018 Wang
10,022,615 B2 7/2018 Huang

(56) References Cited

U.S. PATENT DOCUMENTS

| | | | | |
|---|---|---|---|---|
| 10,022,616 | B1 | 7/2018 | Consol | |
| D827,748 | S | 9/2018 | Desberg | |
| D829,838 | S | 10/2018 | Huang | |
| D865,096 | S | 10/2019 | Desberg | |
| 10,486,052 | B2 | 11/2019 | Choi | |
| D871,532 | S | 12/2019 | Huang | |
| 10,625,830 | B2 | 4/2020 | Lenchner et al. | |
| 10,709,960 | B2 | 7/2020 | Huang | |
| 10,787,218 | B2 | 9/2020 | Wen | |
| D899,543 | S | 10/2020 | Desberg | |
| D911,476 | S | 2/2021 | Huang | |
| D920,197 | S | 5/2021 | Wan | |
| D940,805 | S | 1/2022 | Desberg | |
| D942,572 | S | 2/2022 | Huang | |
| 11,446,562 | B2 | 9/2022 | Desberg | |
| 11,478,693 | B2 | 10/2022 | Huang | |
| 2002/0043774 | A1 | 4/2002 | Chou | |
| 2002/0067015 | A1 | 6/2002 | Tierney et al. | |
| 2002/0149166 | A1 | 10/2002 | Potter | |
| 2002/0195788 | A1 | 12/2002 | Tierney et al. | |
| 2003/0124923 | A1 | 7/2003 | Mercer | |
| 2003/0141688 | A1 | 7/2003 | Lynn | |
| 2003/0155725 | A1 | 8/2003 | Roderick | |
| 2003/0155733 | A1 | 8/2003 | Tan et al. | |
| 2004/0021281 | A1 | 2/2004 | Stephens | |
| 2004/0144582 | A1 | 7/2004 | Baker et al. | |
| 2004/0163867 | A1 | 8/2004 | Hillman | |
| 2004/0212160 | A1 | 10/2004 | Roderick | |
| 2004/0262872 | A1 | 12/2004 | Kang | |
| 2005/0160902 | A1 | 7/2005 | Iwai et al. | |
| 2006/0032682 | A1 | 2/2006 | Hillman | |
| 2006/0032685 | A1 | 2/2006 | Koide | |
| 2006/0038361 | A1 | 2/2006 | Sano | |
| 2006/0049595 | A1 | 3/2006 | Crigler | |
| 2006/0055135 | A1 | 3/2006 | Tracewell et al. | |
| 2006/0055137 | A1* | 3/2006 | Jiang | A63C 17/016 280/87.042 |
| 2006/0163830 | A1* | 7/2006 | Kwak | A63C 17/0033 280/87.042 |
| 2007/0001414 | A1 | 1/2007 | Kang | |
| 2007/0035102 | A1 | 2/2007 | McClain | |
| 2007/0132199 | A1 | 6/2007 | Smith | |
| 2007/0252355 | A1 | 11/2007 | Chen et al. | |
| 2007/0257459 | A1 | 11/2007 | Gang | |
| 2007/0272465 | A1 | 11/2007 | Su | |
| 2007/0273118 | A1* | 11/2007 | Conrad | A63C 17/0033 280/87.042 |
| 2007/0296164 | A1 | 12/2007 | Roderick | |
| 2009/0045598 | A1 | 2/2009 | Lee | |
| 2009/0058028 | A1 | 3/2009 | Chen | |
| 2009/0134591 | A1 | 5/2009 | Chen et al. | |
| 2009/0206571 | A1 | 8/2009 | Francom et al. | |
| 2009/0270002 | A1 | 10/2009 | Crispin | |
| 2009/0295111 | A1 | 12/2009 | O'Rourke | |
| 2010/0222941 | A1 | 9/2010 | Chang | |
| 2010/0225080 | A1 | 9/2010 | Smith | |
| 2010/0253027 | A1 | 10/2010 | Chen et al. | |
| 2011/0006497 | A1 | 1/2011 | Chen et al. | |
| 2011/0037238 | A1 | 2/2011 | Devine | |
| 2011/0127740 | A1 | 6/2011 | Yamabe | |
| 2011/0187069 | A1 | 8/2011 | Marcel | |
| 2012/0187648 | A1* | 7/2012 | Chen | A63C 17/016 280/87.042 |
| 2013/0001910 | A1 | 1/2013 | Hsu | |
| 2013/0168936 | A1* | 7/2013 | Morita | A63C 17/0033 280/87.042 |
| 2013/0277939 | A1 | 10/2013 | Yamabe | |
| 2014/0210175 | A1 | 7/2014 | Hsu | |
| 2015/0160902 | A1 | 6/2015 | Tsujita | |
| 2016/0144267 | A1* | 5/2016 | Huang | A63C 17/12 180/181 |
| 2016/0332062 | A1 | 11/2016 | Wu et al. | |
| 2017/0056756 | A1 | 3/2017 | Pikulski | |
| 2017/0151489 | A1 | 6/2017 | Kim | |
| 2018/0273129 | A1 | 9/2018 | Baron | |
| 2018/0296907 | A1* | 10/2018 | Huang | A63C 17/014 |
| 2018/0318698 | A1 | 11/2018 | Ji | |
| 2018/0361226 | A1 | 12/2018 | Cho | |
| 2019/0070486 | A1* | 3/2019 | Shi | A63C 17/12 |
| 2019/0176019 | A1 | 6/2019 | Huang | |
| 2020/0346099 | A1* | 11/2020 | Li | A63C 17/016 |
| 2021/0077892 | A1 | 3/2021 | Desberg | |
| 2021/0077894 | A1 | 3/2021 | Huang | |
| 2022/0096913 | A1 | 3/2022 | Chen et al. | |

FOREIGN PATENT DOCUMENTS

| | | | |
|---|---|---|---|
| CN | 101309730 | | 11/2008 |
| CN | 201205442 | | 3/2009 |
| CN | 201482126 | U | 5/2010 |
| CN | 201505425 | U | 6/2010 |
| CN | 202070117 | U | 12/2011 |
| CN | 206183946 | | 5/2017 |
| CN | 207157383 | U | 3/2018 |
| CN | 304695609 | S | 6/2018 |
| CN | 207667107 | U | 7/2018 |
| CN | 214209406 | U | 9/2021 |
| DE | 202008012754 | | 1/2009 |
| DK | 176806 | | 10/2009 |
| EP | 1511541 | | 3/2005 |
| EP | 1679101 | | 7/2006 |
| GB | 2318519 | | 4/1998 |
| GB | 2464676 | | 4/2010 |
| JP | H0I-117385 | U | 8/1989 |
| JP | 10-211313 | | 8/1998 |
| JP | 2000-500369 | | 1/2000 |
| JP | 2001-029663 | | 2/2001 |
| JP | A 2002-502743 | | 1/2002 |
| JP | 2005-204961 | | 8/2005 |
| JP | 2005-537820 | | 12/2005 |
| JP | A 2008-545480 | | 12/2008 |
| JP | A 2015-527908 | | 9/2015 |
| JP | 2017-536222 | A | 12/2017 |
| KR | 10 20050060368 | | 6/2005 |
| KR | 200 400 315 | Y1 | 11/2005 |
| KR | 200 410 530 | Y1 | 3/2006 |
| KR | 20070047491 | | 5/2007 |
| KR | 10-2007-0098467 | W | 10/2007 |
| KR | 20090003996 | U | 4/2009 |
| KR | 10-0921839 | | 10/2009 |
| KR | 10-20010110239 | | 12/2011 |
| KR | 20120000804 | U | 2/2012 |
| KR | 200462622 | Y1 | 9/2012 |
| KR | 200465548 | Y1 | 2/2013 |
| KR | 20160002496 | A | 1/2016 |
| SU | 1405865 | | 4/1986 |
| TW | 247446 | | 5/1995 |
| TW | 266104 | | 12/1995 |
| TW | M427179 | U | 4/2012 |
| TW | M481045 | U | 7/2014 |
| TW | M560326 | U | 5/2018 |
| WO | WO 1993/01870 | A1 | 2/1993 |
| WO | WO 1997/018865 | | 5/1997 |
| WO | WO 1999/39787 | | 8/1999 |
| WO | WO 2002/040116 | | 5/2002 |
| WO | WO 2003/092831 | | 11/2003 |
| WO | WO 2004/105901 | A1 | 12/2004 |
| WO | WO 2006/022472 | | 3/2006 |
| WO | WO 2007/102645 | | 9/2007 |
| WO | WO 2007/111466 | | 10/2007 |
| WO | WO 2007/117092 | | 10/2007 |
| WO | WO 2007/127554 | | 11/2007 |
| WO | WO 2007/139356 | | 12/2007 |
| WO | WO 2009/036074 | | 3/2009 |
| WO | WO 2009/100722 | | 8/2009 |
| WO | WO 2010/019627 | | 2/2010 |
| WO | WO 2012/083950 | | 6/2012 |
| WO | WO 2013/012129 | A1 | 1/2013 |
| WO | WO 2014/009760 | | 1/2014 |
| WO | WO 2016/086066 | | 6/2016 |
| WO | WO 2016/094806 | A1 | 6/2016 |
| WO | WO 2018/195103 | | 10/2018 |

(56) References Cited

FOREIGN PATENT DOCUMENTS

| | | |
|---|---|---|
| WO | WO 2020/181093 | 9/2020 |
| WO | WO 2021/055852 | 3/2021 |
| WO | WO 2022/072367 A1 | 4/2022 |

OTHER PUBLICATIONS

About: Skateboarding; The Wave http://skateboard.about.com/cs/fringeboarding/gr/XBoard.html; Jan. 2007, in 2 pages.
Micelle' Electric Wave Board [XinCheJian], URL—http://xinchejian.com/2011/05/07/miclles-electric-wave-board/; May 2011, in 6 pages.
The Wave, Streetsurfing, http://www.streetsurfing.com/wave/skating.html; Mar. 2007, in 2 pages.
International Search Report and Written Opinion in International Application No. PCT/US2020/021203, dated Jun. 11, 2020 in 12 pages.

* cited by examiner

POWERED WHEELED BOARD

INCORPORATION BY REFERENCE

This application claims the priority benefit under 35 U.S.C. § 119 of U.S. Patent Application No. 62/814,450, filed Mar. 6, 2019, the entirety of which is hereby incorporated by reference. In addition, U.S. Pat. Nos. 7,195,259, 7,600,768, and 9,682,309 are hereby incorporated by reference in their entirety herein. The embodiments of the powered personal mobility vehicle described herein can include any of the features described in the aforementioned patents, however such patents should not be used in construing terms related to the powered personal mobility vehicle described herein.

BACKGROUND

Field

The present disclosure relates to personal mobility vehicles, such as skateboards. In particular, the present disclosure relates to personal mobility vehicles with at least one powered wheel (e.g., a powered front wheel and/or a powered rear wheel) and/or other features.

Description of Certain Related Art

Many types of personal mobility vehicles exist, such as skateboards, scooters, bicycles, karts, etc. A user can ride such a vehicle to travel from place to place.

SUMMARY

A need exists for new and/or improved personal mobility vehicle designs, which may provide a new riding experience or unique functionality. The systems, methods and devices described herein have innovative aspects, no single one of which is indispensable or solely responsible for their desirable attributes. Without limiting the scope of the claims, certain features of some embodiments will now be summarized.

Various powered personal mobility vehicles are described in this disclosure. According to some embodiments, the powered personal mobility vehicle can include a deck configured to support a user. The deck can have a forward portion, a rearward portion, and a neck portion spacing apart the forward portion and the rearward portion. The neck portion can be configured to enable the deck to twist about a longitudinal axis of the vehicle. The vehicle can include a first wheel assembly. The first wheel assembly can include a first swivel wheel connected to the forward portion of the deck. The vehicle can include a second wheel assembly. The second wheel assembly can include a second swivel wheel connected to the rearward portion of the deck. The first and second wheel assemblies can be positioned along the longitudinal axis of the vehicle and disposed entirely beneath the deck. The vehicle can include a battery. The battery can be connected to a bottom surface of the forward portion of the deck. A portion of the battery can be positioned directly above a portion of the first swivel wheel when the first and second swivel wheels are on a flat horizontal riding surface. The vehicle can include a motor operably coupled to the battery and configured to drive one of the first and second wheel assemblies.

In some embodiments, the motor can be configured to transfer rotational force to the first swivel wheel and can be disposed entirely within the first swivel wheel.

In some embodiments, at least one of the first swivel wheel and the second swivel wheel can be configured to swivel 360 degrees. In some embodiments, the first wheel assembly can include a limiter configured to limit the degree to which the first swivel wheel can pivot. In some embodiments, the first swivel wheel and the second swivel wheel can be configured to swivel independently.

In some embodiments, the first swivel wheel can be powered and the second swivel wheel can be non-powered. The first and second swivel wheels can have similar diameters.

In some embodiments, the vehicle can include a panel covering a recess in the forward portion of the deck. The panel can be removable to provide access to an upper portion of the first wheel assembly that extends upward into the recess in the deck from beneath the deck.

In some embodiments, the rearward portion of the deck can include a handle. The handle can be an opening that extends through the deck and can be configured to receive a user's hand.

In some embodiments, the neck portion of the deck can include a rotational coupling connected at a first end to the forward portion of the deck and at a second end, opposite the first end, to the rearward portion of the deck.

In some embodiments, the first wheel assembly and the second wheel assembly can each be mounted to the deck at an inclined angle relative to horizontal. The inclined angle can be 40-45 degrees relative to horizontal.

According to some embodiments, the deck can have a forward portion and a rearward portion, the forward portion and the rearward portion spaced apart by a neck portion. The vehicle can include a front wheel assembly connected to the forward portion of the deck. The front wheel assembly can include a powered swivel wheel having a motor and a tire. The motor can be disposed entirely within the tire. The vehicle can include a rear wheel assembly connected to the rearward portion of the deck. The rear wheel assembly can include a non-powered swivel wheel. The front and rear wheel assemblies can be positioned along the longitudinal axis of the vehicle. A diameter of the powered swivel wheel of the front wheel assembly can be approximately equal to a diameter of the non-powered swivel wheel of the rear wheel assembly.

In some embodiments, at least one of the powered swivel wheel and the non-powered swivel wheel can be configured to swivel 360 degrees. In some embodiments, the front wheel assembly can include a limiter configured to limit the degree to which the powered swivel wheel can pivot. In some embodiments, the powered swivel wheel and the non-powered swivel wheel can be configured to swivel independently.

In some embodiments, the front wheel assembly and the rear wheel assembly can each be mounted to the deck at an inclined angle relative to horizontal, the inclined angle being 40-45 degrees relative to horizontal.

According to some embodiments, the vehicle can include a first wheel assembly coupled to the deck. The first wheel assembly can include a powered swivel wheel and a first mounting assembly. A motor can be disposed within the powered swivel wheel. The vehicle can include a second wheel assembly coupled to the deck. The second wheel assembly can include a non-powered swivel wheel and a second mounting assembly. The first wheel assembly and the second wheel assembly can be positioned along the longitudinal axis of the vehicle. An upper surface of the deck can include a first recess and a second recess. Each of the first and second recesses can include an opening at its base. The first recess can be covered by a first removable panel. The second recess can be covered by a second removable panel. A portion of the first mounting assembly can extend upward from beneath the deck into the opening at the base of the first recess. A portion of the second mounting assembly can extend upward from beneath the deck into the opening at the base of the second recess.

In some embodiments, the first wheel assembly can include a limiter configured to limit the degree to which the powered swivel wheel can pivot.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION OF CERTAIN EMBODIMENTS

Figure 1:
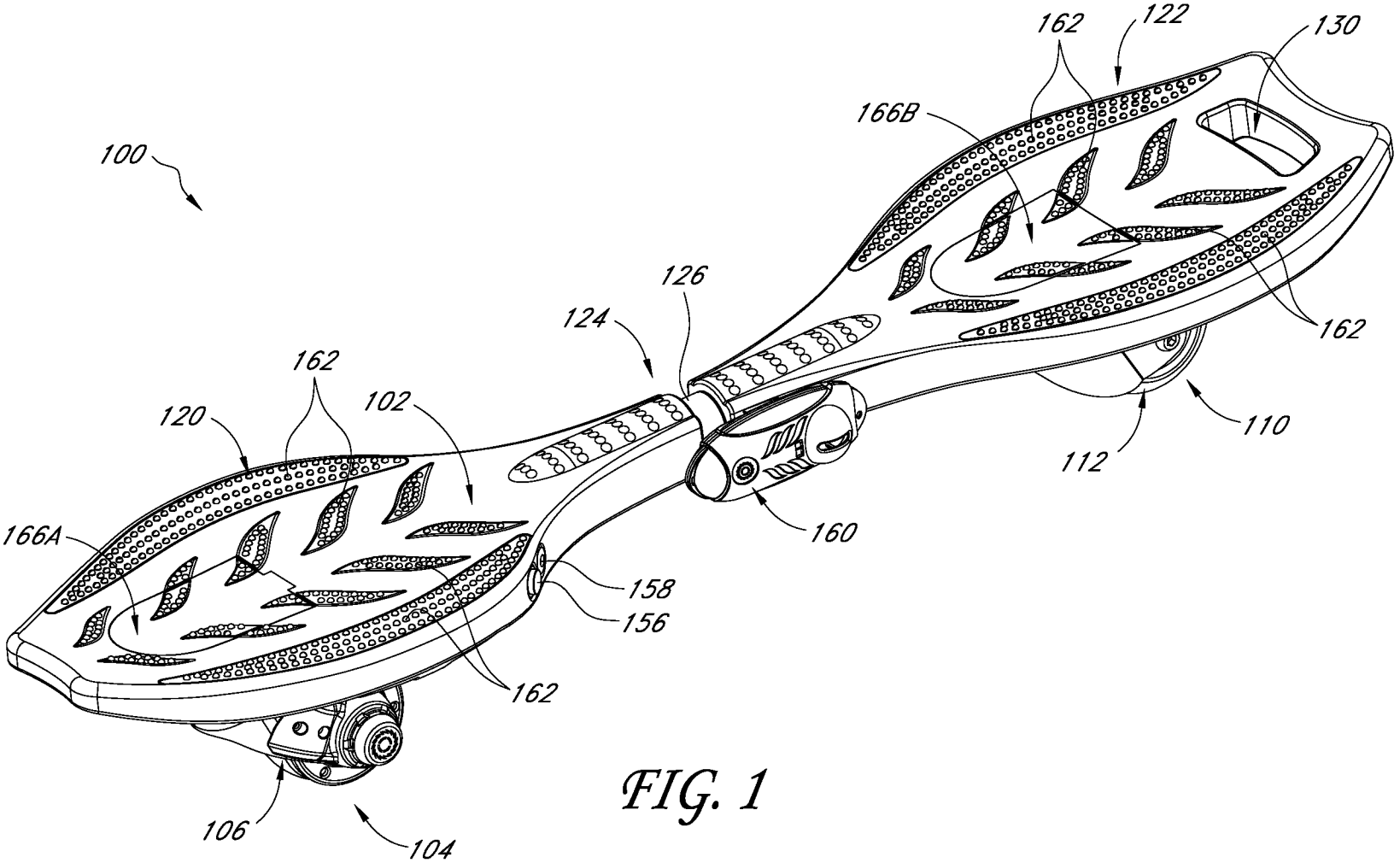
FIG. 1 is a top perspective view of an embodiment of a powered personal mobility vehicle.

Embodiments of systems, components and methods of assembly and manufacture will now be described with reference to the accompanying figures, wherein like numerals refer to like or similar elements throughout. Although several embodiments, examples and illustrations are disclosed below, the inventions described herein extend beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Various embodiments of a powered personal mobility vehicle are disclosed. As disclosed in more detail below, the vehicles can include one or more swivel (e.g., caster) wheels, such as a powered front swivel wheel and a non-powered rear swivel wheel. Conventionally, this combination was thought to render the vehicle front-heavy, unstable, difficult to ride, and/or hard to control. This combination was typically thought to be particularly problematic when used on vehicles (e.g., wheeled boards) configured to permit twisting or flexing of the deck. Nevertheless, certain embodiments described herein establish that a vehicle can successfully include a powered front swivel wheel and one or more additional swivel wheels. In spite of the aforementioned and other concerns, such a vehicle can be sufficiently controllable and stable to provide an enjoyable riding experience.

Overview

FIGS. 1-4 illustrate a powered personal mobility vehicle 100 having a deck 102 configured to support a user, the deck 102 being connected with a first or front wheel assembly 104 and a second or rear wheel assembly 110. In some embodiments, the front wheel assembly 104 can include a front wheel 106 and a mounting assembly 108 configured to mount the front wheel 106 to the deck 102. In some embodiments, the rear wheel assembly 110 can include a rear wheel 112 and a mounting assembly 114 configured to mount the rear wheel 112 to the deck 102. In some embodiments, the front wheel assembly 104 and the rear wheel assembly 110 are aligned along the longitudinal axis of the vehicle 100. In some embodiments, the front wheel assembly 104 and the rear wheel assembly 110 are disposed entirely beneath the deck 102 when coupled to the deck 102. In some embodiments, the mounting assemblies 108, 114 of the front and rear wheel assemblies 104, 110 are configured to move (e.g., pivot or rock) relative to the deck 102.

In some embodiments, the front wheel 106 and/or the rear wheel 112 can be powered (i.e., driven by a motor). In some embodiments, the powered wheel (i.e., the driven wheel) can be used to steer the vehicle 100. In some embodiments, the vehicle 100 has two caster (e.g., swivel) wheels. In some embodiments, the vehicle 100 has a front caster wheel and a rear caster wheel. For example, in some variants, the front wheel 106 and/or the rear wheel 112 is a swivel (e.g., caster) wheel. In some embodiments, the front wheel 106 and/or the rear wheel 112 can be a powered swivel wheel. The rear wheel assembly 110 can be configured to rotate 360 degrees. The front wheel assembly 104 can be configured to rotate 360 degrees or can be limited in rotation, such as to rotating less than or equal to about 120 degrees.

Figure 2:
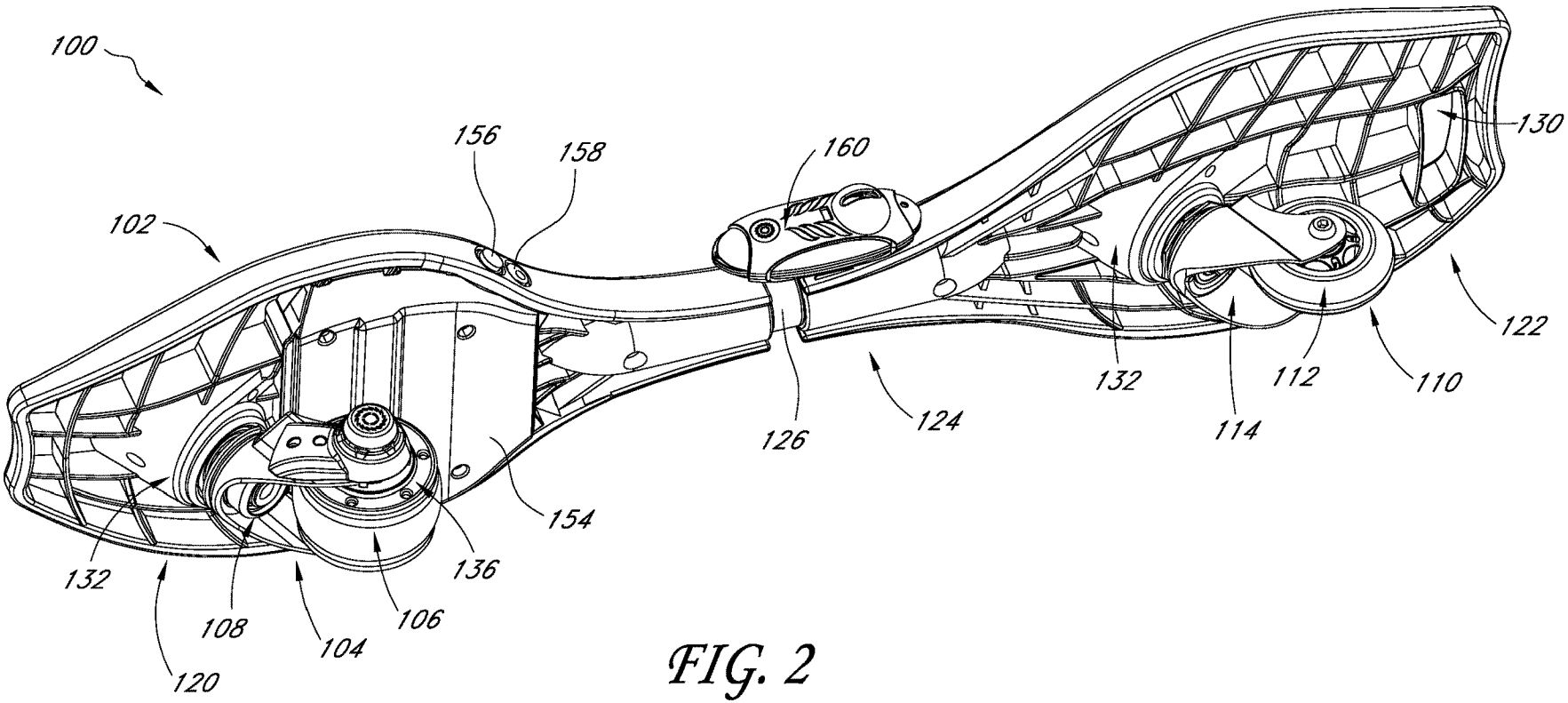
FIG. 2 is a bottom perspective view of the vehicle of FIG. 1.
Figure 3:
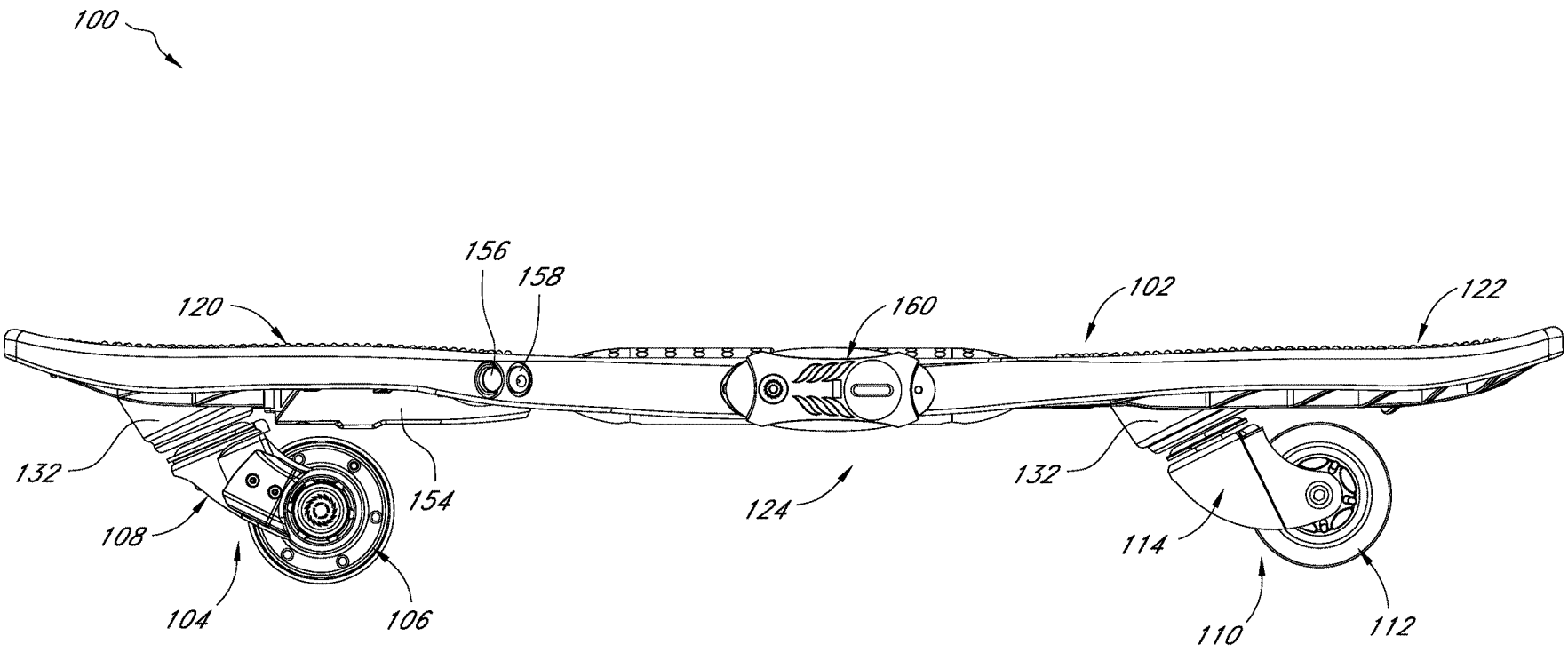
FIG. 3 is a side view of the vehicle of FIG. 1.

In some embodiments, one of the front wheel 106 and the rear wheel 112 is powered and the other of the front wheel 106 and the rear wheel 112 is non-powered. For example, in some embodiments, as illustrated in FIGS. 1-3, the front wheel 106 is a powered swivel wheel and the rear wheel 112 is a non-powered swivel wheel. The powered front wheel 106 can be used to steer the vehicle 100. This arrangement can provide for the desired riding experience and feel, such as to enable drifting of the vehicle 100. The front wheel 106 being a powered wheel can allow the vehicle 100 to be pulled in the direction of travel as opposed to being pushed in the direction of travel by a powered rear wheel. This can improve the user's riding experience and increase the efficiency of the drive arrangement. For example, compared to a powered rear wheel, having a powered front wheel can permit the vehicle 100 to turn tighter corners, facilitate drifting of the rear of the vehicle 100 compared to the front of the vehicle 100 during turns, enable the rear wheel 112 to traverse a turn with a substantially larger radius of curvature compared to the radius of curvature traversed by the front wheel 106, permit the vehicle 100 to follow a path around a turn in which a longitudinal axis of the vehicle 100 substantially departs from parallel to the arc traversed by the front wheel 106, etc.

In some embodiments, the front wheel assembly 104 and the rear wheel assembly 110 can be mounted at an incline relative to the deck 102. In some variants, the front wheel assembly 104 and the rear wheel assembly 110 are mounted at a similar or the same inclined angle (e.g., 20-50 degrees relative to horizontal, 30-55 degrees relative to horizontal, 40-45 degrees relative to horizontal, etc.). Inclined wheel assemblies 104, 110 can enable the deck 102 to be positioned closer to the riding surface, which can lower the center of gravity of the vehicle 100, increase the user's control over the vehicle 100, and/or facilitate turning of the wheel assemblies 104, 110.

In some embodiments, as shown in FIG. 3, the front wheel 106 and the rear wheel 112 can have similar diameters or the same diameters. The wheels 106, 112 can have similar diameters or the same diameters even when one of the wheels 106, 112 is powered (e.g., houses a motor) and the other of the wheels 106, 112 is non-powered (e.g., does not house a motor). In some embodiments, one of the front wheel 106 and the rear wheel 112 can have a diameter that is larger than the other of the front wheel 106 and the rear wheel 112.

In some embodiments, the front wheel 106 and the rear wheel 112 can have similar thicknesses. The thickness can be measured in an axial direction. In some embodiments, one of the front wheel 106 and the rear wheel 112 can be thicker than the other of the front wheel 106 and the rear wheel 112 (e.g., to provide space for a motor). For example, in some variants, the powered or driven wheel can be thicker than the non-powered wheel. In some embodiments, the powered or driven wheel is at least about 1.25-3.50 times thicker than the non-powered wheel (e.g., about 1.3 times thicker, about 2.0 times thicker, about 2.25 times thicker, etc.). As shown in FIG. 2, in some embodiments, the front wheel 106 is thicker than the rear wheel 112.

In some embodiments, the vehicle 100 includes more than two wheels (such as three wheels, four wheels, etc.). The wheels can include caster wheels and/or fixed wheels. In some embodiments, some of the wheels can be auxiliary wheels that are offset from the longitudinal axis of the vehicle 100.

In some embodiments, the vehicle 100 can include a motor 136 configured to transfer rotational force to the front wheel 106 and/or the rear wheel 112. In some embodiments, the motor 136 can include a housing enclosing a motor and a transmission assembly. In some embodiments, the motor 136 can be disposed at least partially within the front wheel 106 or the rear wheel 112 (i.e., the driven wheel). In some embodiments, the vehicle 100 can include a motor 136 disposed entirely within the front wheel 106 and/or the rear wheel 112. In some embodiments, the motor 136 and one of the front wheel 106 and the rear wheel 112 (i.e., the driven wheel) can be coupled to a drive arrangement, such as a chain drive, belt drive, or gear drive.

In some embodiments, the vehicle 100 can comprise a power source, such as a battery 150. In some embodiments, the vehicle 100 can comprise a power switch 156 and a charging port 158. The power switch 156 can be configured to be actuated by the user to turn the vehicle 100 on and off. The charging port 158 can be configured to be connected to an external power source to recharge the battery 150.

In some embodiments, the vehicle 100 can be operated using a remote control 160. In some embodiments, the remote control 160 is configured to be stored on the vehicle 100 when not in use. For example, the remote control 160 can be removably secured to a portion of the deck 102 along a perimeter of the deck 102 (e.g., along the perimeter of the deck 102 towards the middle of the vehicle 100, as shown in FIG. 1). In some embodiments, the remote control 160 is a device configured to wirelessly communicate with a controller 152 on the vehicle 100, using radio frequency (RF) transmission, in order to operate the vehicle 100. For example, in some variants, a user can use the remote control 160 to cause the speed of the motor to change (e.g., increase and decrease), cause the vehicle 100 to brake, and/or cause the vehicle 100 to change its direction of motion (e.g., reverse).

Deck

In some embodiments, as shown in FIGS. 1-2, the deck 102 comprises a first portion or forward portion 120 and a second portion or rearward portion 122. In some variants, the deck 102 includes a neck portion 124 disposed between the forward portion 120 and the rearward portion 122. In some embodiments, the forward portion 120 and the rearward portion 122 of the deck 102 are wider than the neck portion 124. For example, as shown in FIG. 1, the width of the deck 102 can taper along the neck portion 124.

In some embodiments, the neck portion 124 can be configured to allow the deck 102 to twist or flex about a longitudinal axis of the vehicle 100. For example, in some embodiments, the neck portion 124 can include a rotational coupling 126 connected at a first end to the forward portion 120 and at a second end, opposite the first end, to the rearward portion 122. In some variants, the rotational coupling 126 is a cylindrical member. The rotational coupling 126 can permit rotational movement of the forward portion 120 and the rearward portion 122 relative to one another along the longitudinal axis of the vehicle 100 (e.g., when the user shifts his or her weight on the deck 102). In some embodiments, the rotational coupling 126 can include one or more pivot assemblies. In some embodiments, the rotational coupling 126 can include a biasing element configured to bias the forward portion 120 and the rearward portion 122 into a neutral or aligned relative position.

In some embodiments, as shown in FIG. 1, the deck 102 can include a handle 130. In some embodiments, the handle 130 comprises an opening that extends through the deck 102 that is configured to receive a user's hand, enabling the user to conveniently carry the vehicle 100. The handle 130 can be disposed towards an end of the deck 102. In some variants, the handle 130 is disposed on the end of the deck 102 opposite the driven wheel. In some variants, the handle 130 is disposed on the end of the deck 102 closest to the driven wheel.

In some embodiments, as shown in FIG. 1, the upper surface of the deck 102 includes anti-slip regions 162. The anti-slip regions 162 can act as a grip for the user's feet, making the portions of the deck 102 that the user places his or her feet on when riding the vehicle 100 less slippery, thereby reducing the risk of injury and improving the riding experience.

Figure 4:
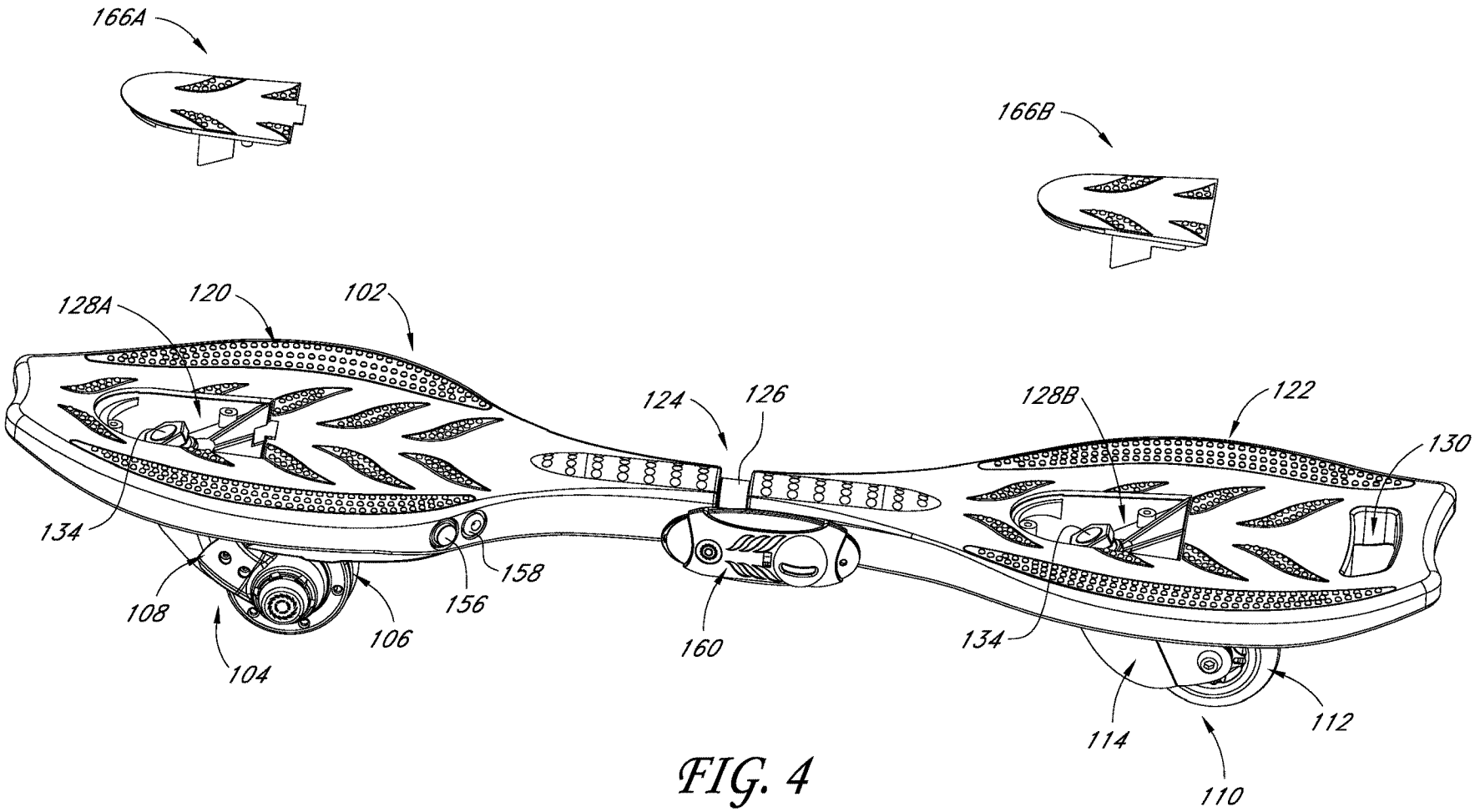
FIG. 4 is a top perspective view of the vehicle of FIG. 1 showing an embodiment of a front access panel and an embodiment of a rear access panel separated from the deck of the vehicle.

In some embodiments, an upper surface of the forward portion 120 and/or an upper surface of the rearward portion 122 can include a removable panel covering a recess in the deck 102. For example, as shown in FIG. 4, in some embodiments, the deck 102 includes an access panel 166A for covering a recess 128A in the forward portion 120 of the deck 102 and an access panel 166B for covering a recess 128B in the rearward portion 122 of the deck 102. The access panels 166A, 166B can be removable such that the manufacturer or the user can access portions of the mounting assemblies 108, 114 of the front wheel assembly 104 and the rear wheel assembly 110, respectively.

In some embodiments, the deck 102 comprises mounts 132 configured to receive portions of the mounting assemblies 108, 114 of the front wheel assembly 104 and the rear wheel assembly 110. For example, as illustrated in FIG. 2, in some embodiments, the deck 102 includes a first mount 132 on the forward portion 120 and a second mount 132 on the rearward portion 122. In some embodiments, the mount 132 on the forward portion 120 of the deck 102 can include an opening configured to receive a portion of the front wheel assembly 104 and the mount 132 on the rearward portion 122 of the deck 102 can include an opening configured to receive a portion of the rear wheel assembly 110. For example, in some embodiments, as shown in FIGS. 5-6, the mounting assemblies 108, 114 can extend upward from beneath the deck 102, into openings in the mounts 132, and into the recesses 128A, 128B in the deck 102.

In some variants, removal of the access panels 166A, 166B provides access to the portions of the mounting assemblies 108, 114 of the front wheel assembly 104 and the rear wheel assembly 110 that extend upward from beneath the deck 102 into the recesses 128A, 128B in the deck 102, such as portions of the mounting shafts 118 of the mounting assemblies 108, 114. Being able to access the tops of the mounting shafts 118 of the mounting assemblies 108, 114 can permit fasteners 134 (e.g., nuts) to be connected to the tops of the mounting shafts 118 (e.g., the tops of threaded bolts) as shown in FIGS. 5-6. Securing the wheel assemblies 104, 110 to the deck 102 using fasteners 134 protected within the recesses 128A, 128B by the access panels 166A, 166B can make the connection between the wheel assemblies 104, 110 and the deck 102 more secure and/or reduce the number of components positioned beneath the deck 102. In some embodiments, the access panels 166A, 166B can facilitate assembly of the vehicle 100.

Figure 7B:
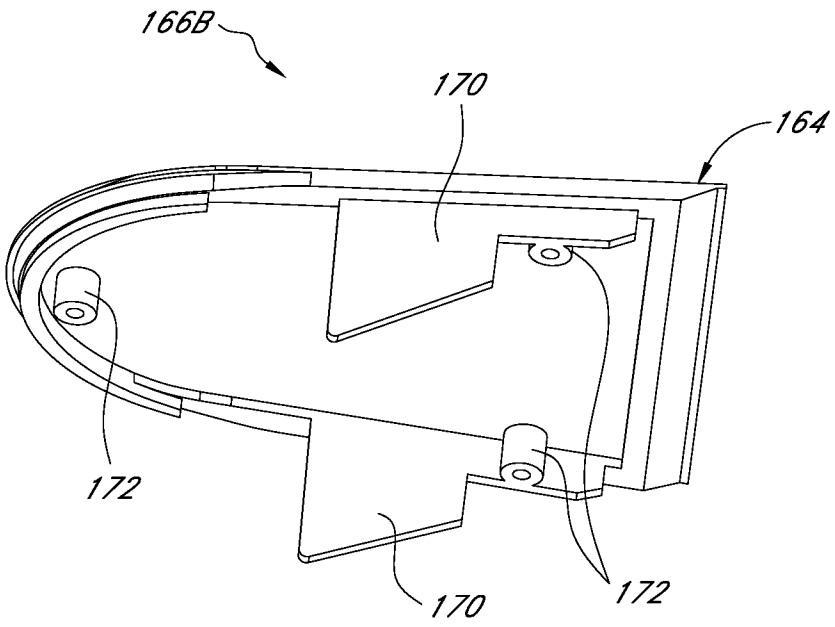
FIGS. 7A and 7B are bottom perspective views of the access panels of the vehicle of FIG. 1.
Figure 7A:
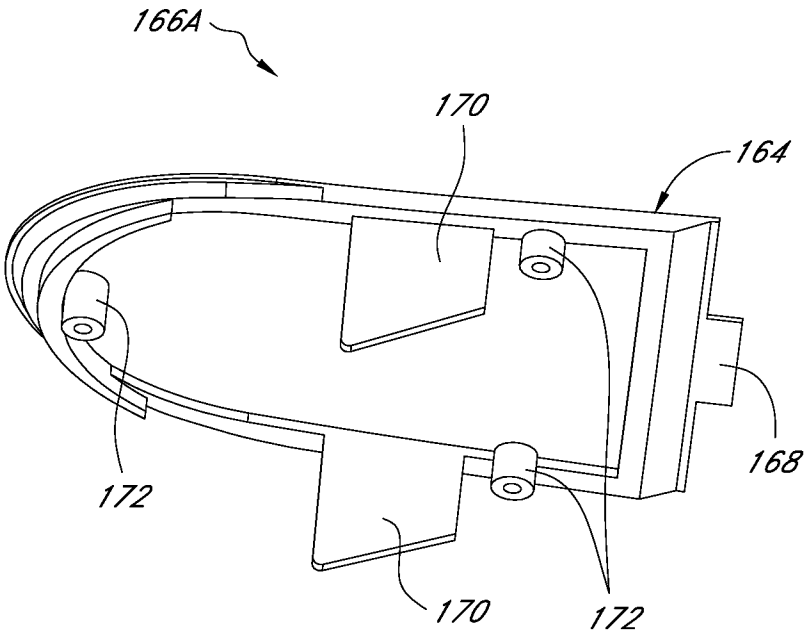

In some embodiments, the access panels 166A, 166B and the recesses 128A, 128B in the deck 102 have corresponding features or mating features. For example, in some embodiments, as shown in FIGS. 7A-7B, the access panel 166A, 166B can a have a body 164 and a plurality of arms 170 and supports 172 extending from the body 164 (e.g., 2-4 arms 170, 2-4 supports 172, etc.). In some variants, the body 164 of the access panel 166A, 166B can be an elongate plate. In some embodiments, the arms 170 and supports 172 can extend downward from a lower surface or a side surface of the body 164 in a direction perpendicular to the body 164. The arms 170 and supports 172 can be configured to extend downward into the recess 128A, 128B in the deck 102 when the access panel 166A, 166B is coupled to the deck 102. The arms 170 can secure and/or limit lateral movement of the access panel 166A, 166B relative to the deck 102 when disposed over the recess 128A, 128B. The supports 172 can align with corresponding supports 174 in the recess 128A, 128B of the deck 102. In various embodiments, when the access panels 166A, 166B are installed in the deck 102, upper surfaces of the access panels 166A, 166B are generally flush with the adjacent portions of the deck 102. See FIG. 1. This can hide the access panels 166A, 166B and/or can increase rider comfort (e.g., compared to having upper surfaces that protrude from the deck 102).

Figure 6:
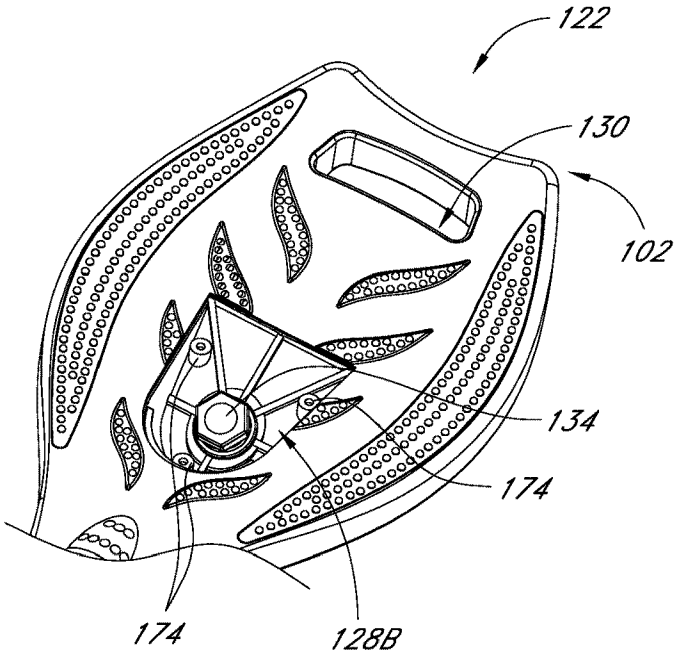
FIG. 6 is a detailed view of a rearward portion of the deck of the vehicle of FIG. 1 with the rear access panel removed.
Figure 5:
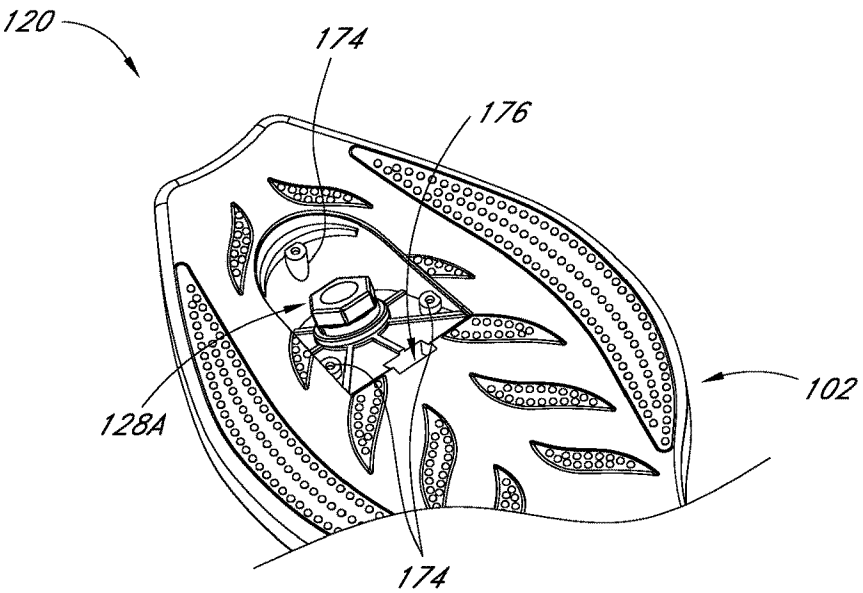
FIG. 5 is a detailed view of a forward portion of the deck of the vehicle of FIG. 1 with the front access panel removed.

In some embodiments, as shown in FIGS. 5-6, the recess 128A, 128B includes a plurality of supports 174 (e.g., 2-4 supports 174). The supports 174 can extend upward, in a direction away from the deck 102. In some embodiments, the supports 172 on the access panel 166A, 166B can rest on, or connect with, the supports 174 in the recess 128A, 128B of the deck 102 when the access panel 166A, 166B is attached to the deck 102.

In some variants, the access panel 166A, 166B can include a first mating feature (e.g., a tab 168) configured to mate with a corresponding second mating feature (e.g., a recess in the deck 102). The tab 168 can extend along a longitudinal axis of the access panel 166A, 166B. In some embodiments, as shown in FIG. 7A, the tab 168 can extend further than the rest of the body 164. In some embodiments, the user or manufacturer can lift the tab 168 from the recess 176 on the deck 102 to facilitate separating the access panel 166A, 166B from the deck 102.

Wheels

Figure 9:
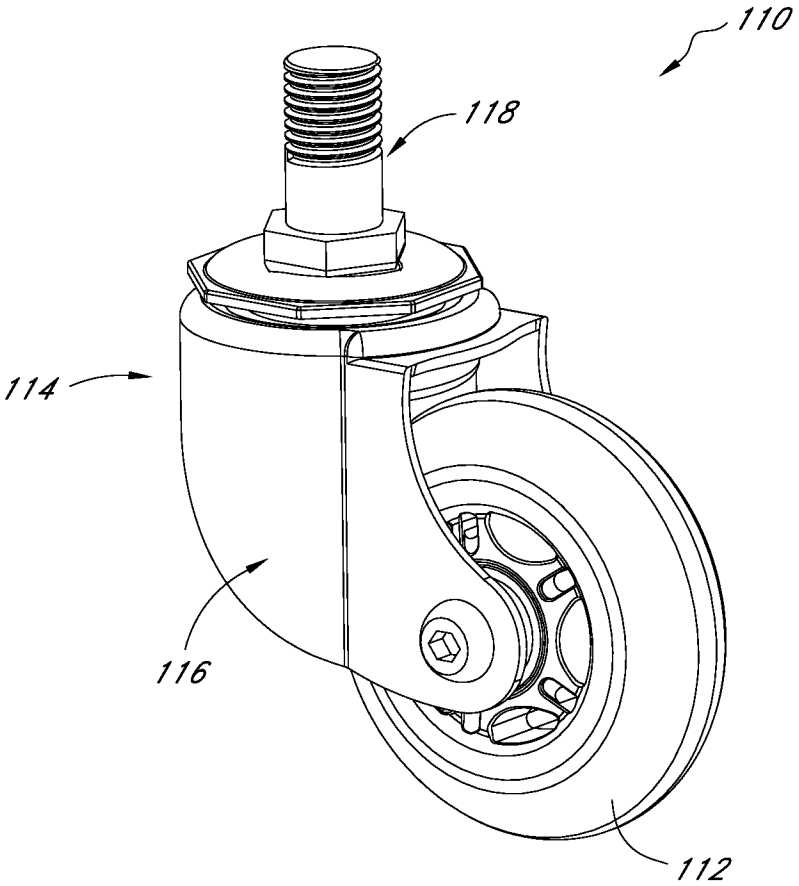
FIGS. 8 and 9 are top perspective views of the wheel assemblies of the vehicle of FIG. 1.
Figure 8:
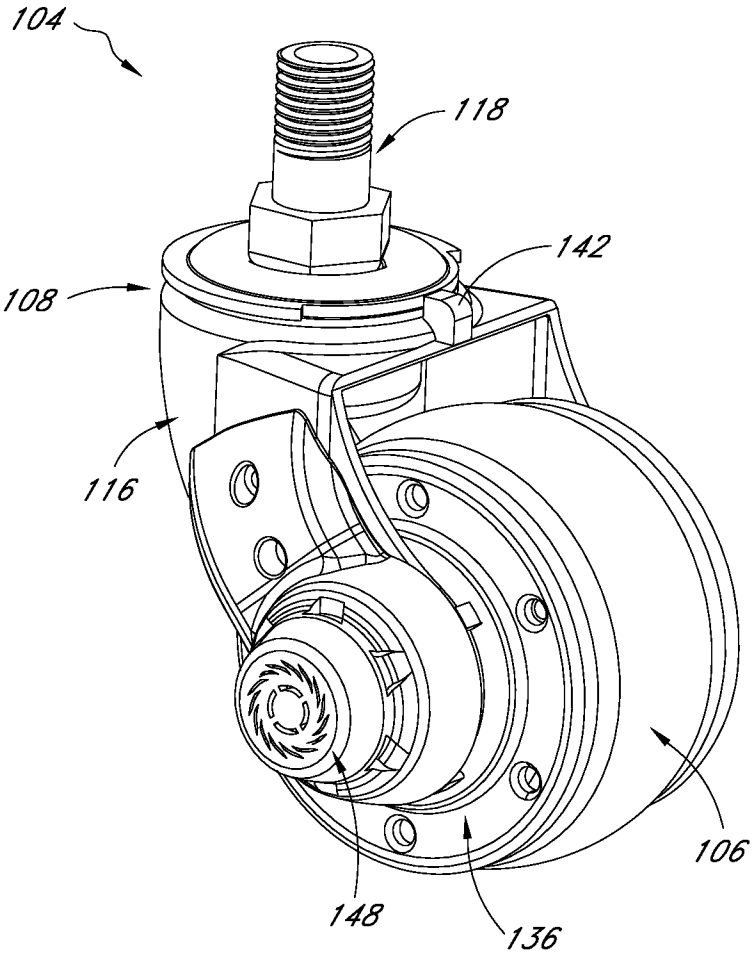

FIGS. 8 and 9 illustrate example embodiments of swivel wheel assemblies. While the illustrated embodiment of the vehicle 100 comprises a powered swivel wheel towards the front of the vehicle 100 and a non-powered swivel wheel towards the rear of the vehicle 100, the features described in relation to the front wheel assembly 104 are not limited to a wheel assembly mounted to the forward portion 120 of the vehicle 100 and the features described in relation to the rear wheel assembly 110 are not limited to a wheel assembly mounted to the rearward portion 122 of the vehicle 100. Any of the features described above in relation to the front wheel assembly 104 and the rear wheel assembly 110, and any of the features described below in relation to the front wheel assembly 104 and the rear wheel assembly 110, can be included in any wheel that is mounted to the vehicle 100.

As illustrated in FIGS. 8 and 9, the front wheel assembly 104 and the rear wheel assembly 110 can each include a mounting assembly 108, 114 comprising a mounting plate 116 and a mounting shaft 118 (e.g., a threaded bolt). In some embodiments, the front wheel 106 is supported by the mounting assembly 108 and the rear wheel 112 is supported by the mounting assembly 114.

In some embodiments, the front wheel assembly 104 and/or the rear wheel assembly 110 can include a cover 148. In some embodiments, as shown in FIG. 8, a portion of the cover 148 can extend along a portion of the mounting plate 116, over a portion of the wheel 106, and/or over a portion of the motor 136. As discussed in more detail below, in certain embodiments, the cover 148 can protect an electrical connection (e.g., a wire) that extends between the motor 136 and a battery and/or controller.

Figure 10:
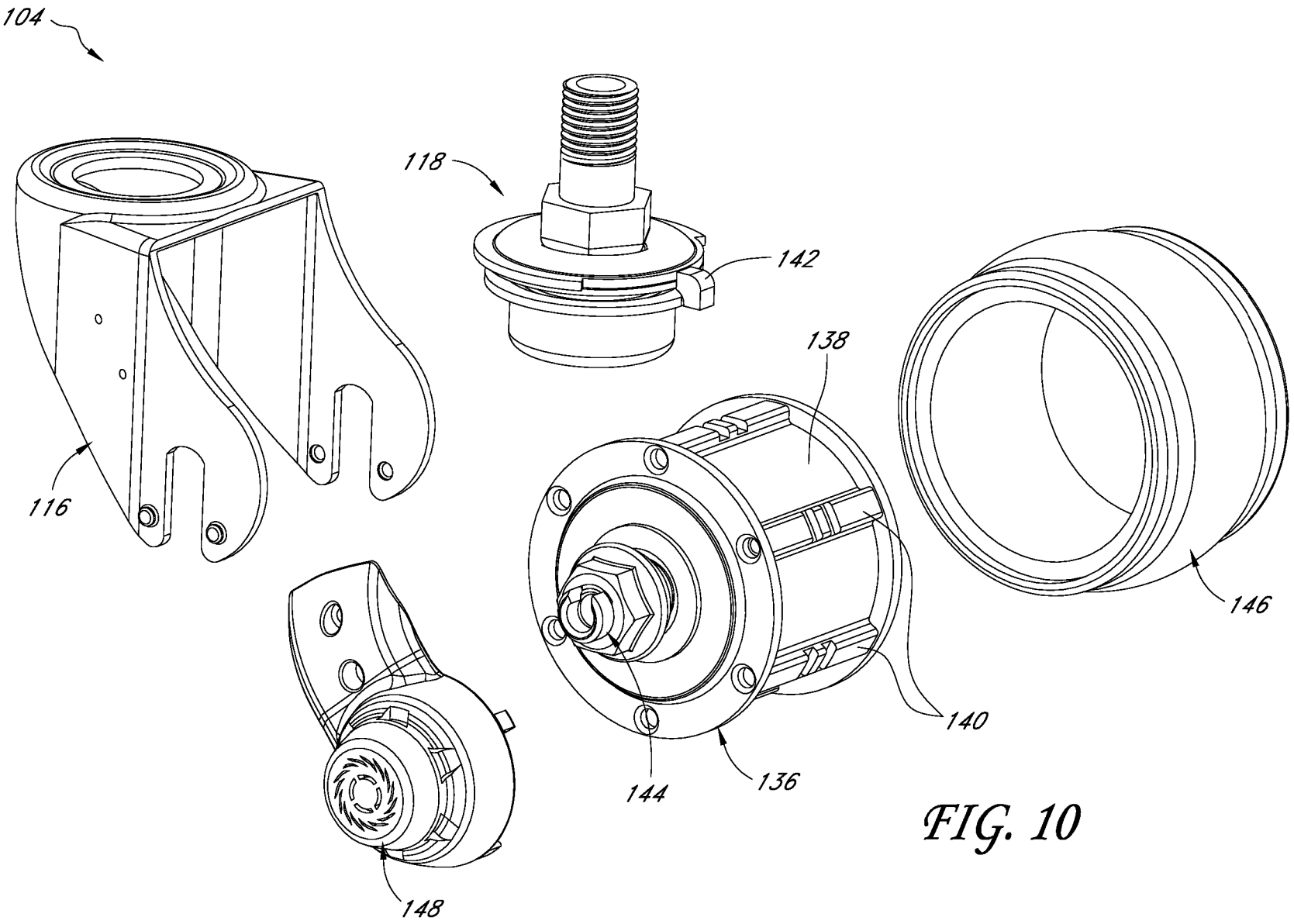
FIG. 10 is an exploded view of the wheel assembly of FIG. 8.

In some embodiments, the front wheel assembly 104 and/or the rear wheel assembly 110 can be configured to swivel 360 degrees about a swivel axis. In some embodiments, rotation of the front wheel 106 and/or the rear wheel 112 can be limited. For example, as shown in FIGS. 8 and 10, in some variants, the front wheel assembly 104 can include a limiter 142 configured to limit the degree to which the front wheel 104 can pivot (i.e., swivel). In some embodiments, the front wheel 106 and the rear wheel 112 can be configured to swivel independently. In some embodiments, the front wheel assembly 104 and/or the rear wheel assembly 110 can include a biasing element configured to bias the front wheel 106 and/or the rear wheel 112 towards a neutral resting position in which the front wheel 106 and/or the rear wheel 112 extends along the longitudinal axis of the vehicle 100.

Figure 11B:
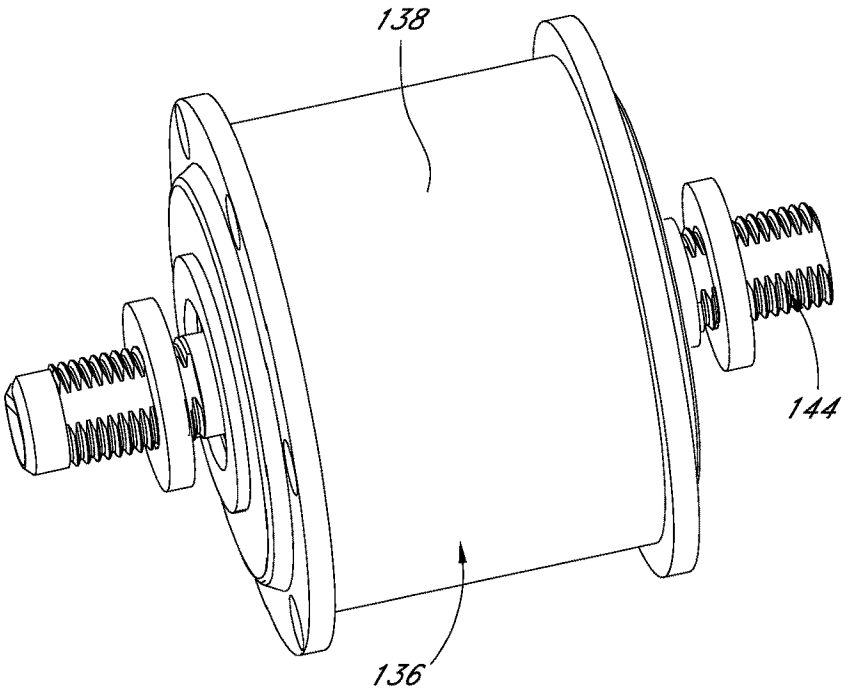
FIG. 11B is a top perspective view of another embodiment of a motor.
Figure 11A:
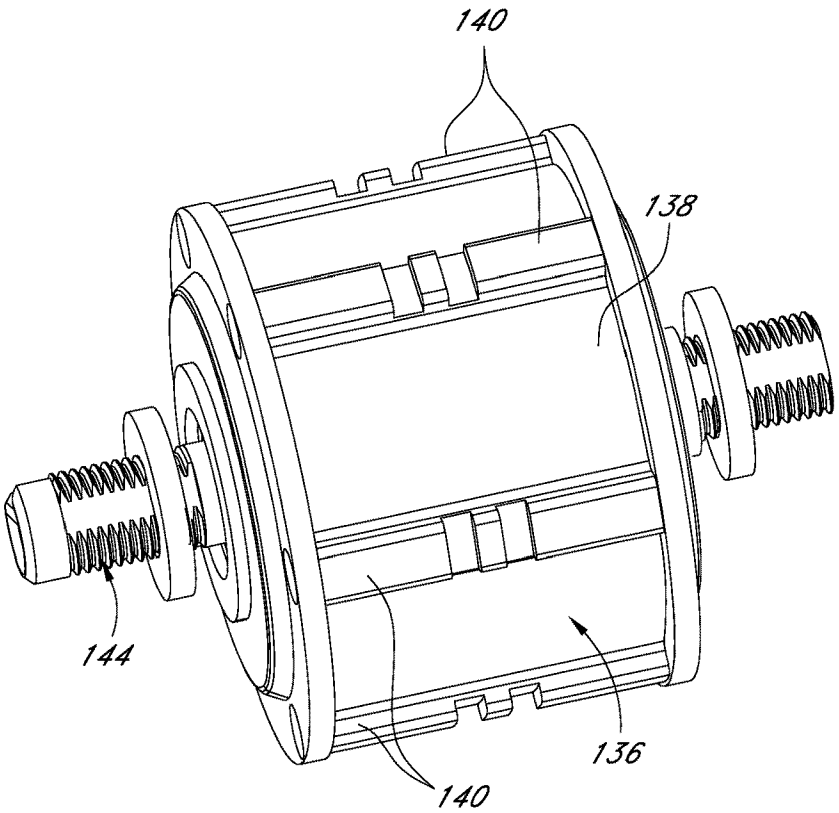
FIG. 11A is a top perspective view of the motor of FIG. 10.

As shown in FIG. 10, in some embodiments, the motor 136 can be integrated in the front wheel assembly 104 with the motor 136 disposed entirely within the front wheel 106. In some embodiments, the motor 136 surrounds the axis of rotation of the front wheel 106. For example, in some embodiments, as shown in FIGS. 10, 11A, and 11B, the central portion of the motor 136 is hollow and configured to receive the axle 144 of the front wheel 106. In some embodiments, the axle 144 passes through the entire width of the motor 136, extending from a first side of the motor 136 to a second side of the motor 136 opposite the first side.

In some variants, as shown in FIGS. 10 and 11A, the outer surface 138 of the motor 136 can have protrusions 140, such as circumferentially spaced apart ridges. In some embodiments, as shown in FIG. 11B, a continuous portion of the outer surface 138 of the motor 136 can be smooth (i.e., not include protrusions along the central portion of the outer surface 138 of the motor 136).

The front wheel assembly 104 can include a traction element 146, such as a tire, configured to couple to the motor 136. In some embodiments, the traction element 146 is coupled to the motor 136 such that at least a portion of an inner surface of the traction element 146 contacts, and is flush with, at least a portion of the outer surface 138 of the motor 136. In some embodiments, the traction element 146 is coupled to a motor 136 having an outer surface 138 with protrusions 140. The traction element 146 can be configured to be thick enough (e.g., in the radial direction) to reduce vibrations or bumpiness during riding that might otherwise be caused by the protrusions 140 on the outer surface 138 of the motor 136. For example, in some embodiments, the traction element 146 can have a thickness of at least about: 5 mm, 7 mm, 10 mm, or 12 mm. In some embodiments, the traction element 146 can have a diameter of at least about: 65 mm, 70 mm, 75 mm, or 80 mm.

In some embodiments, as illustrated in FIG. 10, the traction element 146 can have a curved profile, such as a crown. For example, in some variants, the central portion of the traction element 146 is thicker, or extends further radially outward, than the lateral edges of the traction element 146. Such a traction element 146 profile can reduce the amount of drag caused by the front wheel assembly 104 during riding and/or prevent or reduce the traction element 146 from interfering with desirable swivel wheel riding characteristics. In some variants, the traction element 146 with the crown automatically increases the amount of contact between the traction element 146 and the riding surface (e.g., the ground) during turns and automatically increases the amount of contact between the traction element 146 and the riding surface during straight riding. This can allow for tighter turns and/or greater straight-line speed.

Figure 11C:
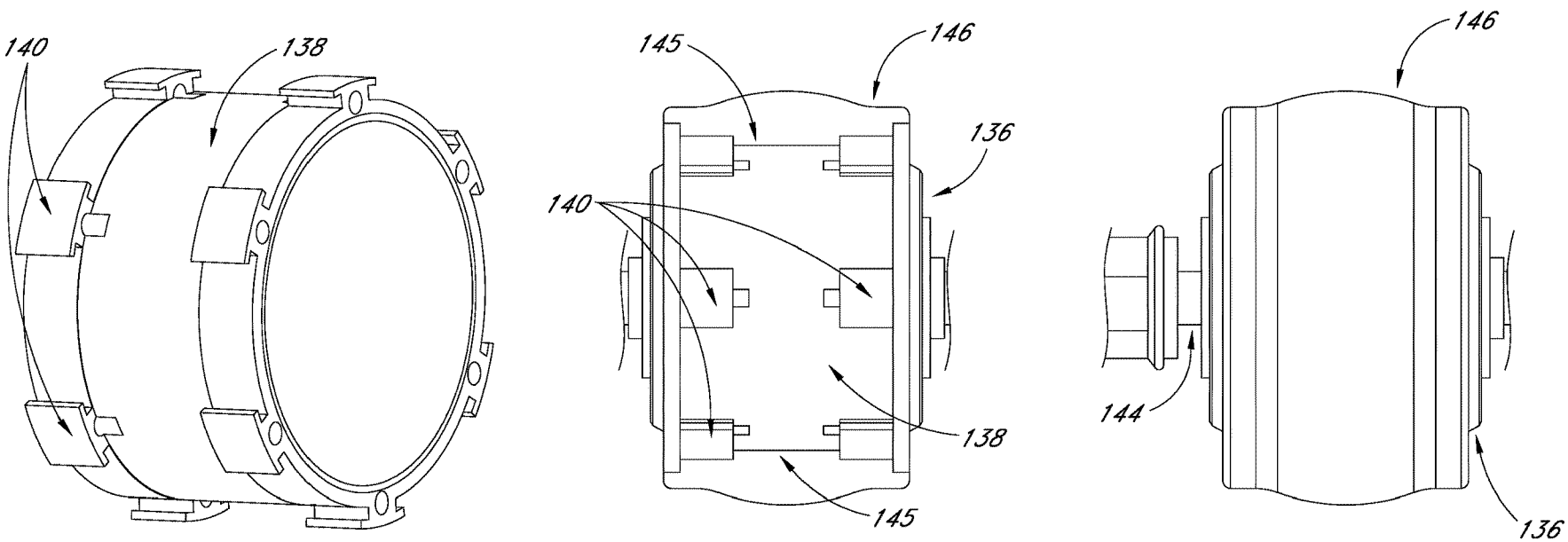
FIG. 11C illustrates an embodiment of a motor and an embodiment of a tire configured to mate with said motor.

In some embodiments, as illustrated in FIG. 11C, the outer surface 138 of the motor 136 can include protrusions 140 positioned towards the lateral edges of the outer surface 138. The protrusions 140 disposed along a first lateral edge of the outer surface 138 can mirror (e.g., be symmetrical to) the protrusions 140 disposed along a second lateral edge of the outer surface 138 opposite the first lateral edge. The central region of the outer surface 138 (i.e., between the protrusions 140 on the first and second lateral edges) can have a width of at least about: 10 mm, 13 mm, 15 mm, 20 mm, or 25 mm. The central region can be smooth (e.g., without protrusions). The traction element 146 can be configured to conform to the outer surface 138 of the motor 136. For example, the traction element 146 can include a mating feature 145 configured to mate with a portion of the motor 136. As illustrated in FIG. 11C, the mating feature 145 of the traction element 146 can be a thickened region of the traction element 146. In some variants, a central region of the traction element 146 can protrude such that the central region of the traction element 146 is configured to contact the central region of the outer surface 138 of the motor 136. When the traction element 146 is coupled to the motor 136, the protrusions 140 on the lateral edges of the outer surface 138 of the motor 136 can abut the central region of the traction element 146 and help secure the traction element 146 in position relative to the motor 136.

Figure 11D:
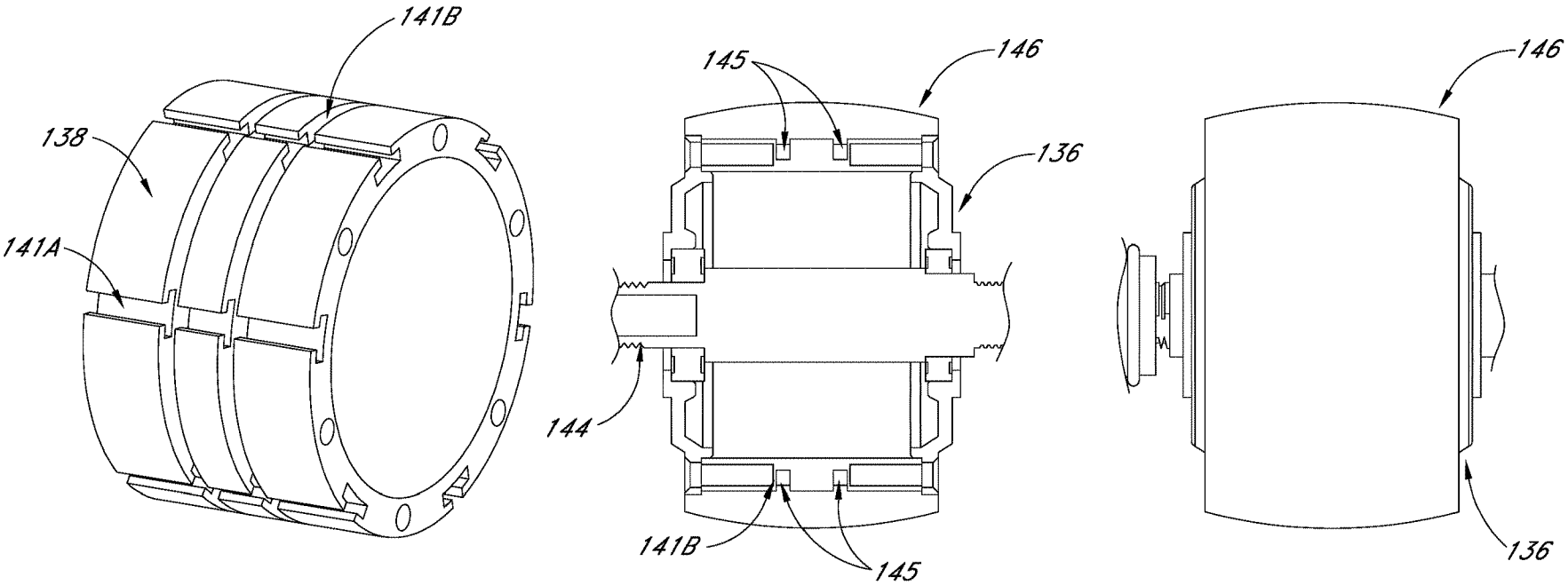
FIG. 11D illustrates another embodiment of a motor and an embodiment of a tire configured to mate with said motor.

In some embodiments, as illustrated in FIG. 11D, the outer surface 138 of the motor 136 can include a plurality of recesses 141. In some embodiments, the outer surface 138 of the motor 136 includes a first recess 141A extending along the width of the outer surface 138 and a second recess 141B extending circumferentially around the periphery of the outer surface 138. In some embodiments, the first recess 141A is transverse to the second recess 141B. In some variants, the first recess 141A can have a height of at least about: 1 mm, 2 mm, 3 mm, or 4 mm. In some variants, the second recess 141B can have a width of at least about: 1 mm, 2 mm, 3 mm, or 4 mm. In some embodiments, the first recess 141A is configured to limit horizontal movement of the traction element 146 relative to the motor 136 when the traction element 146 is coupled to the motor 136. In some embodiments, the second recess 141B is configured to limit vertical movement of the traction element 146 relative to the motor 136 when the traction element 146 is coupled to the motor 136.

In some embodiments, the outer surface 138 includes a plurality of spaced apart recesses 141A extending along the width of the outer surface 138 and/or a plurality of spaced apart recesses 141B extending circumferentially around the periphery of the outer surface 138. The recesses 141A can be circumferentially spaced apart by at least about: 5 mm, 15 mm, 30 mm, or 45 mm. The recesses 141B can be laterally spaced apart by at least about: 5 mm, 10 mm, 15 mm, or 20 mm. As shown in FIG. 11D, in some embodiments, the mating feature 145 of the traction element 146 includes a plurality of protrusions corresponding to, and configured to mate with, the plurality of recesses 141A and/or the plurality of recesses 141B of the outer surface 138.

Figure 11E:
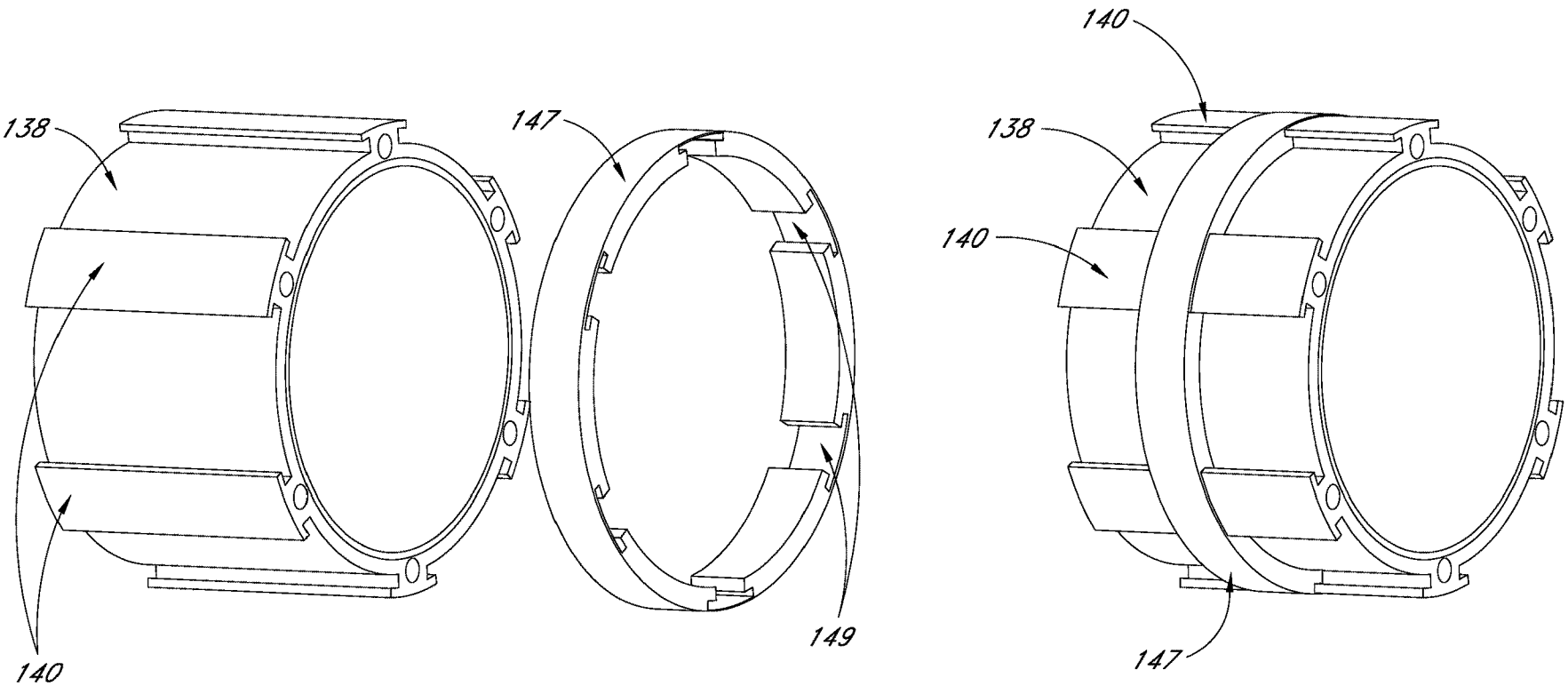
FIG. 11E illustrates an embodiment of a motor housing and an embodiment of an anti-vibration element configured to mate with said motor housing.

In certain embodiments, as illustrated in FIG. 11E, an anti-vibration element 147, such as a nylon ring, can be coupled to the outer surface 138 of the motor 136 to reduce vibrations or bumpiness during riding that might otherwise be caused by protrusions 140 on the outer surface 138 and/or other features of the outer surface 138. In some embodiments, the anti-vibration element 147 can be coupled to a central portion of the outer surface 138 of the motor 136 and be positioned between the motor 136 and the traction element 146. In some embodiments, the width of the motor 136 is larger than the width of the anti-vibration element 147. In some embodiments, the anti-vibration element 147 extends across about one-half, one-third, one-forth, one-fifth, or one-sixth of the width of the motor 136. In some embodiments, the width of the anti-vibration element 147 is at least about: 4 mm, 6 mm, 8 mm, 10 mm, or 12 mm.

In some embodiments, an inner surface of the anti-vibration element 147 includes a plurality of indentations 149 spaced apart along the inner circumference of the anti-vibration element 147. The indentations 149 can be configured to receive the protrusions 140 on the outer surface 138 of the motor 136. When the anti-vibration element 147 is coupled to the outer surface 138 of the motor 136, the anti-vibration element 147 can provide a relatively smooth, continuous surface that the traction element 146 can be disposed on top of. This arrangement can improve the riding experience by reducing vibrations during riding that might otherwise be associated with the protrusions 140 on the outer surface 138 of the motor 136.

In certain embodiments, the vehicle 100 is configured to enable powered and non-powered riding. This can allow a user to choose the method of locomotion, extend riding range, provide use of the vehicle when the battery is depleted, etc. Some conventional powered boards were only configured for powered riding because, for example, they included large motors that applied a substantial amount of resistance to rotation of the motorized wheel when the motor was not driving the wheel, which could inhibit rolling of the wheel and hinder non-powered riding of the vehicle. In certain embodiments of the vehicle 100, the motor 136 applies less resistance, or substantially no resistance, to rotation of the motorized wheel (e.g., the front wheel 106), even when the motor 136 is not driving the motorized wheel. This can facilitate non-powered riding of the vehicle, such as by the user pushing-off the ground or alternately twisting the front and rear portions of the deck about the longitudinal axis of the vehicle to provide locomotive force. As mentioned above, in some embodiments the motor 136 is housed within the front wheel 106 (e.g., the motor 136 is positioned entirely within the inside radius of the traction element 146). Such a small motor can aid in providing less or substantially no resistance to rotation of the wheel 106, even when the motor 136 is not driving the wheel 106. Further, such a configuration can protect and/or obscure the motor 136.

Power and Control

The vehicle 100 can include a controller 152, which can include a processor and a memory. The controller 152 can be operably connected to a battery 150 and the motor 136. For example, an electrical connection, such as wires, can connect the controller 152, motor 136, and battery 150 to enable controlled supply of electrical power from the battery 150 to the motor 136. The wires can extend along a side of the wheel assembly 104 and pass into an axle 144 of the wheel 106 to connect to the motor 136. As mentioned above, the cover 148 can obscure and/or protect the wires. The wires can have sufficient slack or otherwise be configured to enable rotation of the wheel assembly 104. In some variants, the electrical connection comprises mating traces or other electrical contacts in the mount 132 and wheel mounting assembly 108, which can remove the need for external wires. The controller 152 can include a receiver and/or transceiver that can wirelessly communicate with the remote control 160.

Figure 12:
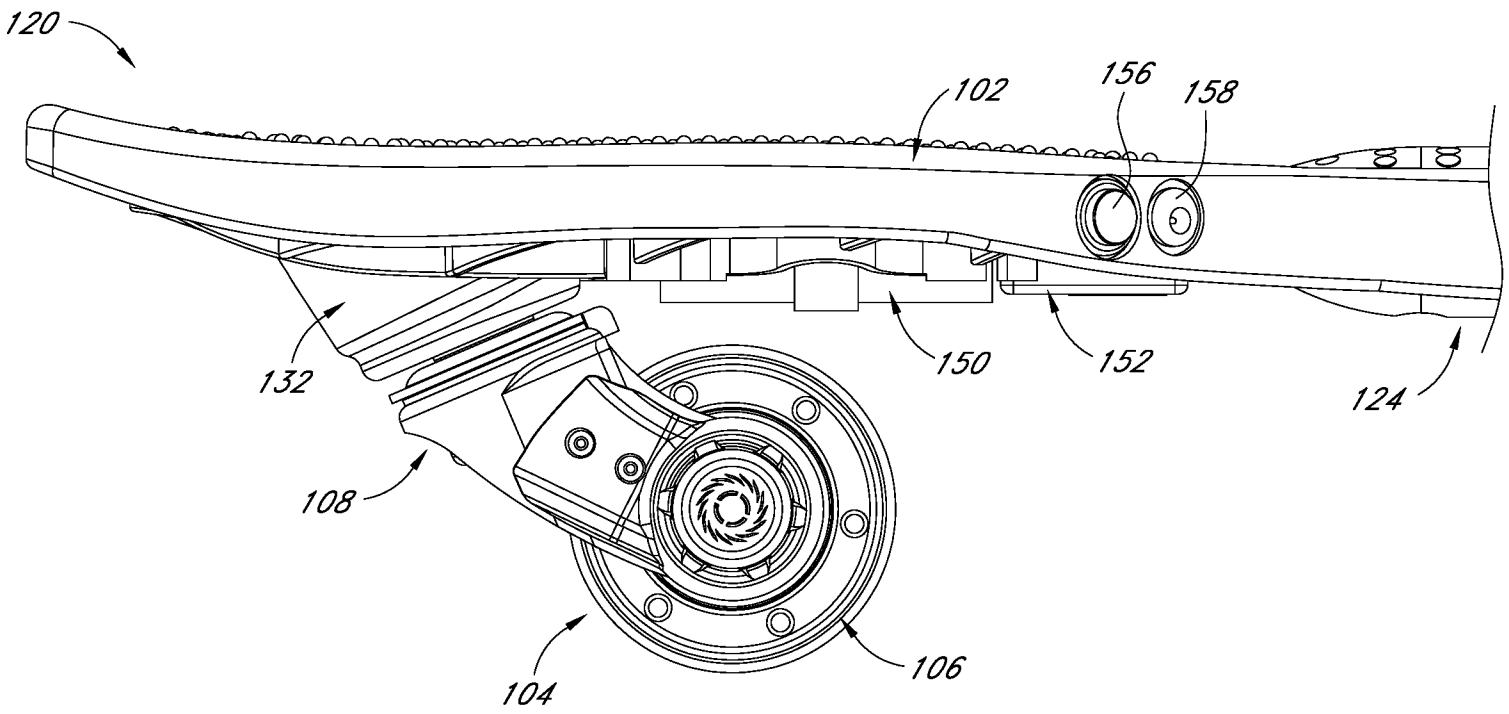
FIG. 12 is a side view of a forward portion of the vehicle of FIG. 1 with a cover over the battery and controller removed.
Figure 13:
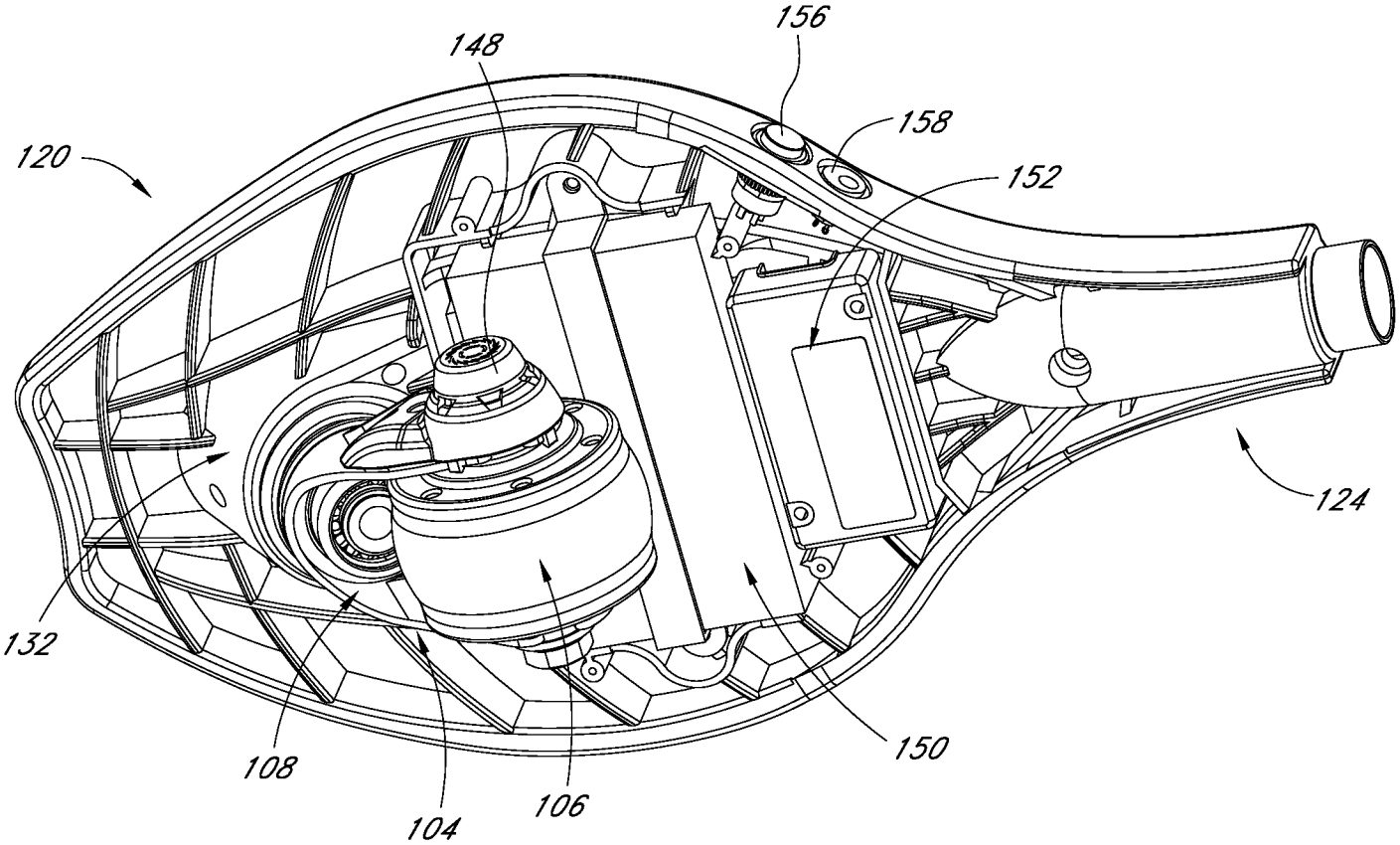
FIG. 13 is a bottom perspective view of the forward portion of the vehicle of FIG. 1 with the cover over the battery and controller removed.
Figure 14:
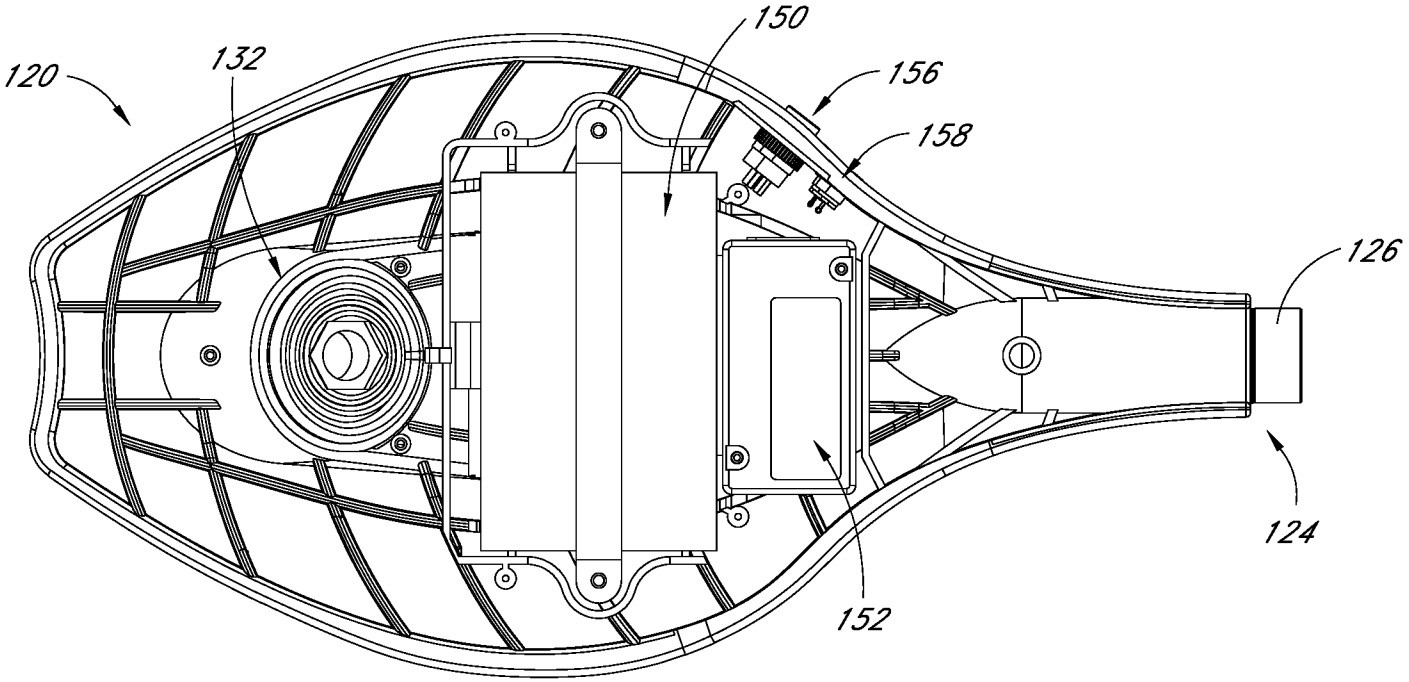
FIG. 14 is a bottom view of the forward portion of the vehicle of FIG. 1 with the front wheel assembly and the cover over the battery and controller removed.

In some embodiments, the battery 150 and/or controller 152 are disposed beneath the deck 102. In some variants, the battery 150 and the controller 152 can be disposed in the same housing 154 (FIG. 2). In some embodiments, the battery 150 and the controller 152 can be positioned on the same side of the deck 102 (e.g., the battery 150 and the controller 152 can be connected to the forward portion 120 or the rearward portion 122 of the deck 102). For example, in some embodiments, as illustrated in FIGS. 12-14, the battery 150 and the controller 152 are connected to the bottom or underside of the forward portion 120 of the deck 102 (i.e., facing the riding surface when the vehicle 100 is in use). In some embodiments, as shown in FIG. 14, the battery 150 and/or the controller 152 can be attached to the deck 102 at a location disposed between a mount 132 on the deck 102 and the neck portion 124 of the deck 102 along the longitudinal axis of the vehicle 100.

In some embodiments, a portion of the battery 150 and/or a portion of the controller 152 can extend above a portion of the rear wheel 112. In some embodiments, a portion of the battery 150 and/or a portion of the controller 152 can extend above a portion of the front wheel 106. For example, as shown in FIG. 12, in some embodiments, at least half of the width of the battery 150 can extend above at least half of the length of the front wheel 106 along the longitudinal axis of the vehicle 100. In some embodiments, 50-100% of the width of the battery 150 can extend above 50-100% of the length of the front wheel 106 or the rear wheel 112 along the longitudinal axis of the vehicle (e.g., 50% of the width of the battery 150 can extend above 70% of the length of the wheel, 60% of the width of the battery 150 can extend above 50% of the length of the wheel, 70% of the width of the battery 150 can extend above 60% of the length of the wheel, etc.).

In some embodiments, such as in the embodiment of FIGS. 12-14, the front wheel 106 of the vehicle 100 is a powered swivel wheel, with the motor 136 disposed entirely within the front wheel 106, and a portion of the battery 150 extends above a portion of the front wheel 106. In this configuration, the powered swivel wheel assembly 104 (including the motor 136), the battery 150, and the controller 152 are connected to the forward portion 120 of the deck 102 and disposed beneath the deck 102. Positioning the battery 150 close to the powered swivel wheel assembly 104 advantageously makes it possible to avoid running wiring through the middle of the vehicle 100 (e.g., through the neck portion 124 of the deck 102), which can reduce the likelihood of issues caused by wiring being pulled on during the twisting or flexing of the forward portion 120 relative to the rearward portion 122 along the neck portion 124.

Certain Terminology

Certain terminology may be used in the description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import. Throughout the description herein, like numbers refer to like components.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described.

A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

CONCLUSION

Various illustrative embodiments and examples of powered personal mobility vehicles have been disclosed. Many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Some embodiments have been described in connection with the accompanying drawings. The figures are drawn to scale, but such scale should not be interpreted to be limiting. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Also, any methods described herein may be practiced using any device suitable for performing the recited steps.

In summary, various illustrative embodiments and examples of powered personal mobility vehicles have been disclosed. Although the powered personal mobility vehicles have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow as well as their full scope of equivalents.

What is claimed is:

1. A powered personal mobility vehicle comprising:

a deck configured to support a user, the deck having:

a forward portion;

a rearward portion;

a neck portion spacing apart the forward portion and the rearward portion, the neck portion being configured to enable the deck to twist about a longitudinal axis of the vehicle;

a first wheel assembly comprising a first swivel wheel connected to the forward portion of the deck;

a second wheel assembly comprising a second swivel wheel connected to the rearward portion of the deck;

the first and second wheel assemblies being positioned along the longitudinal axis of the vehicle and disposed entirely beneath the deck;

a battery connected to a bottom surface of the forward portion of the deck, a portion of the battery positioned directly above a portion of the first swivel wheel such that a vertical axis extending through a center of the first swivel wheel intersects the battery when the first and second swivel wheels are on a flat horizontal riding surface; and a motor operably coupled to the battery and configured to drive one of the first and second wheel assemblies.

2. The vehicle of claim 1, wherein the motor is configured to transfer rotational force to the first swivel wheel and is disposed entirely within the first swivel wheel.

3. The vehicle of claim 1, wherein at least one of the first swivel wheel and the second swivel wheel is configured to swivel 360 degrees.

4. The vehicle of claim 1, wherein the first wheel assembly comprises a limiter configured to limit the degree to which the first swivel wheel can pivot.

5. The vehicle of claim 1, wherein the first swivel wheel and the second swivel wheel are configured to swivel independently.

6. The vehicle of claim 1, wherein the first swivel wheel is powered and the second swivel wheel is non-powered, the first and second swivel wheels having similar diameters.

7. The vehicle of claim 1, further comprising a panel covering a recess in the forward portion of the deck, the panel being removable to provide access to an upper portion of the first wheel assembly that extends upward into the recess in the deck from beneath the deck.

8. The vehicle of claim 1, wherein the rearward portion of the deck comprises a handle, the handle comprising an opening that extends through the deck and is configured to receive a user's hand.

9. The vehicle of claim 1, wherein the neck portion of the deck comprises a rotational coupling connected at a first end to the forward portion of the deck and at a second end, opposite the first end, to the rearward portion of the deck.

10. The vehicle of claim 1, wherein the first wheel assembly and the second wheel assembly are each mounted to the deck at an inclined angle relative to horizontal, the inclined angle being 40-45 degrees relative to horizontal.

11. A powered personal mobility vehicle, comprising:

a deck configured to support a user, the deck having a forward portion and a rearward portion, the forward portion and the rearward portion spaced apart by a neck portion, the neck portion being configured to enable the deck to twist about a longitudinal axis of the vehicle;

a front wheel assembly connected to the forward portion of the deck, the front wheel assembly comprising a powered swivel wheel having a motor and a tire, the motor disposed entirely within the tire;

a rear wheel assembly connected to the rearward portion of the deck, the rear wheel assembly comprising a non-powered swivel wheel, wherein the front and rear wheel assemblies are positioned along the longitudinal axis of the vehicle; and wherein a diameter of the powered swivel wheel of the front wheel assembly is approximately equal to a diameter of the non-powered swivel wheel of the rear wheel assembly.

12. The vehicle of claim 11, wherein at least one of the powered swivel wheel and the non-powered swivel wheel is configured to swivel 360 degrees.

13. The vehicle of claim 11, wherein the front wheel assembly comprises a limiter configured to limit the degree to which the powered swivel wheel can pivot.

14. The vehicle of claim 11, wherein the powered swivel wheel and the non-powered swivel wheel are configured to swivel independently.

15. The vehicle of claim 11, wherein the front wheel assembly and the rear wheel assembly are each mounted to the deck at an inclined angle relative to horizontal, the inclined angle being 40-45 degrees relative to horizontal.

16. A powered personal mobility vehicle, comprising:

a deck configured to support a user, the deck having a forward portion and a rearward portion, the forward portion and the rearward portion spaced apart by a neck portion, the neck portion being configured to enable the deck to twist about a longitudinal axis of the vehicle;

a first wheel assembly coupled to the deck, the first wheel assembly comprising a powered swivel wheel and a first mounting assembly, wherein a motor is disposed within the powered swivel wheel;

a second wheel assembly coupled to the deck, the second wheel assembly comprising a non-powered swivel wheel and a second mounting assembly, the first wheel assembly and the second wheel assembly being positioned along the longitudinal axis of the vehicle;

wherein an upper surface of the deck comprises a first recess and a second recess, each of the first and second recesses comprising an opening at its base, the first recess being covered by a first removable panel and the second recess being covered by a second removable panel; and wherein a portion of the first mounting assembly extends upward from beneath the deck into the opening at the base of the first recess, and wherein a portion of the second mounting assembly extends upward from beneath the deck into the opening at the base of the second recess.

17. The vehicle of claim 16, wherein at least one of the powered swivel wheel and the non-powered swivel wheel is configured to swivel 360 degrees.

18. The vehicle of claim 16, wherein the first wheel assembly comprises a limiter configured to limit the degree to which the powered swivel wheel can pivot.

19. The vehicle of claim 16, wherein the powered swivel wheel and the non-powered swivel wheel are configured to swivel independently.

20. The vehicle of claim 16, wherein the first wheel assembly and the second wheel assembly are each mounted to the deck at an inclined angle relative to horizontal, the inclined angle being 40-45 degrees relative to horizontal.

* * * * *